US009706326B2

(12) United States Patent
Fukui et al.

(10) Patent No.: US 9,706,326 B2
(45) Date of Patent: Jul. 11, 2017

(54) AUDIO SIGNAL PROCESSING DEVICE, AUDIO SIGNAL PROCESSING METHOD, AND COMPUTER PROGRAM

(71) Applicant: SONY CORPORATION, Minato-ku (JP)

(72) Inventors: Takao Fukui, Tokyo (JP); Ayataka Nishio, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 91 days.

(21) Appl. No.: 14/395,548

(22) PCT Filed: May 7, 2013

(86) PCT No.: PCT/JP2013/062849

§ 371 (c)(1),
(2) Date: Oct. 20, 2014

(87) PCT Pub. No.: WO2013/183392

PCT Pub. Date: Dec. 12, 2013

(65) Prior Publication Data

US 2015/0117648 A1 Apr. 30, 2015

(30) Foreign Application Priority Data

Jun. 6, 2012 (JP) ..... 2012-128989

(51) Int. Cl.
*H04R 5/00* (2006.01)
*H04S 5/02* (2006.01)
(Continued)

(52) U.S. Cl.
CPC ..... *H04S 5/02* (2013.01); *H04S 1/005* (2013.01); *H04S 2400/03* (2013.01); *H04S 2420/01* (2013.01)

(58) Field of Classification Search
CPC .. H04S 2420/01; H04S 1/002; H04S 2400/01; H04S 7/302; H04S 7/305;
(Continued)

(56) References Cited

U.S. PATENT DOCUMENTS

2009/0214045 A1* 8/2009 Fukui ..... H04S 1/005 381/17
2010/0246831 A1* 9/2010 Mahabub ..... G10L 19/018 381/17

FOREIGN PATENT DOCUMENTS

JP 3-214897 A 3/1991
JP 2007-214815 A 8/2007
(Continued)

OTHER PUBLICATIONS

International Search Report issued Jun. 11, 2013 in PCT/JP2013/062849.

*Primary Examiner* — Paul S Kim
*Assistant Examiner* — Norman Yu
(74) *Attorney, Agent, or Firm* — Chip Law Group

(57) ABSTRACT

Provided is an audio signal processing device including a signal processing section that changes, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

12 Claims, 18 Drawing Sheets

(51) Int. Cl.
*H04S 1/00* (2006.01)
*H04R 5/02* (2006.01)

(58) Field of Classification Search
CPC ... H04S 3/00; H04S 3/002; H04S 7/40; H04S 2400/05; H04S 2400/07; H04S 2400/11; H04S 5/02; H04S 7/301; G10K 15/12; H04R 5/00; H04R 5/02; H04R 5/027; H04R 5/04
USPC ..... 381/1, 17, 18–19, 26, 63, 310, 300
See application file for complete search history.

(56) References Cited

FOREIGN PATENT DOCUMENTS

| | | | | |
|---|---|---|---|---|
| JP | 2009-212944 | | * | 9/2009 |
| JP | 2009-212944 | A | | 9/2009 |
| JP | 2011-9842 | A | | 1/2011 |
| JP | 2012-506673 | A | | 3/2012 |
| WO | WO 95/13690 | A1 | | 5/1995 |

* cited by examiner

10
LF
LS
LB
C
LFE
RF
RS
RB
71LF
71LS
71LB
71C
71LFE
71RF
71RS
71RB
LEVEL ADJUSTMENT
72LF
72LS
72LB
72C
72LFE
72RF
72RS
72RB
AMPLIFIER
73LF
73LS
73LB
73C
73LFE
73RF
73RS
73RB
A/D
100
SIGNAL PROCESSING SECTION
74LF
74LS
74LB
74C
74LFE
74RF
74RS
74RB
HEAD-RELATED TRANSFER FUNCTION CONVOLUTION PROCESSING SECTION
75
ADDITION PROCESSING SECTION
75L
L ADDING SECTION
75R
R ADDING SECTION

C : 80%
L : 20%～0%
R : 0%～20%

R : 80%
L : 20%~0%
RS : 0%~20%

AUDIO SIGNAL PROCESSING DEVICE, AUDIO SIGNAL PROCESSING METHOD, AND COMPUTER PROGRAM

TECHNICAL FIELD

The present disclosure relates to an audio signal processing device, an audio signal processing method, and a computer program.

BACKGROUND ART

There is a case where, when a listener wears headphones on the head of the listener to hear sound reproduced signals with both ears of the listener, audio signals reproduced by the headphones are normal audio signals that are provided to speakers located at the right and left in front of the listener. In such a case, it is known that a phenomenon so-called inside-the-head sound localization occurs in which a sound image reproduced by the headphones is trapped inside the head of the listener.

As techniques that solve this problem of the inside-the-head sound localization phenomenon, for example, Patent Literature 1 and Patent Literature 2 disclose a technique called virtual sound image localization. This virtual sound image localization causes headphones or the like to perform reproduction as if sound sources, for example, speakers are present at presupposed positions such as the right and left positions in front of a listener (to virtually localize the sound image at the positions).

In the case of multi-channels including three or more channels, as with a case of two channels, speakers are disposed at virtual sound image localization positions of the respective channels, and head-related transfer functions for the respective channels are measured by, for example, reproducing impulses. Then, the impulse responses of the head-related transfer functions obtained by the measurement may be convolved with audio signals to be provided to drivers for 2-channel sound reproduction of the right and left headphones.

Now, recently, multichannel surround sound systems such as 5.1 channel, 7.1 channel, and 9.1 channel, have been employed in sound reproduction or the like accompanying the reproduction of a video recorded in an optical disk. Also in the case where audio signals in this multichannel surround sound system are subjected to the sound reproduction by 2-channel headphones, the use of the above-described method of virtual sound image localization to perform sound image localization (virtual sound image localization) in conformity with each channel is proposed (e.g., Patent Literature 3).

CITATION LIST

Patent Literature

Patent Literature 1: WO 95/013690
Patent Literature 2: JP 03-214897A
Patent Literature 3: JP 2011-009842A

SUMMARY OF INVENTION

Technical Problem

In the techniques for subjecting audio signals in the multichannel surround sound system to sound reproduction using head-related transfer functions by 2-channel headphones, only by simulating a supposed environment of the speakers, it is difficult to reproduce sound quality and a sound field as they are at the time of hearing with speakers actually disposed. At the time of hearing with headphones, the headphones are firmly fixed on the head of a listener and sound is output from the vicinities of the ears of the listener, but at the time of hearing sound from speakers, the head of a listener is not fixed but moves slightly. Therefore, at the time of hearing sound from speakers, the distances from the speakers to the ears of a listener and the angles (directions) toward the speakers viewed from the listener are not constant.

If reverb components are added more than necessary to reproduce a wide sound field in an attempt to simulate a supposed environment of speakers, the sound reverberates excessively, or out-of-head sound localization is not achieved as much as a supposed distance from the speakers.

Thus, the present disclosure provides a novel and improved audio signal processing device, audio signal processing method, and computer program that can reproduce, at the time of reproducing audio signals in a multichannel surround sound system with 2-channel audio signals, sound quality and a sound field at the time of hearing with speakers actually disposed.

Solution to Problem

According to the present disclosure, there is provided an audio signal processing device including a signal processing section that changes, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

According to the present disclosure, there is provided an audio signal processing method, including a step of changing, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

According to the present disclosure, there is provided a computer program that causes a computer to execute a step of changing, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

Advantageous Effects of Invention

As described above, according to the present disclosure, it is possible to provide a novel and improved audio signal processing device, audio signal processing method, and computer program that can reproduce, at the time of reproducing audio signals in a multichannel surround sound system with 2-channel audio signals, sound quality and a sound field at the time of hearing with speakers actually disposed.

DESCRIPTION OF EMBODIMENTS

Hereinafter, a preferred embodiment of the present disclosure will be described in detail with reference to the accompanying drawings. Note that, in the present specification and the drawings, elements having substantially the same functions and configurations are denoted by the same reference signs, and redundant explanations will be omitted.

Note that the description will be made in the following order.

<1. Embodiment of the Present Disclosure>

[Example for Speaker Arrangement in 7.1 Channel Multichannel Surround Sound]

[Configuration Example of Audio Signal Processing Device]

[Operation Example of Audio Signal Processing Device]

<2. Conclusion>

1. Embodiment of the Present Disclosure

[Configuration Example of Audio Signal Processing Device]

Figure 1:
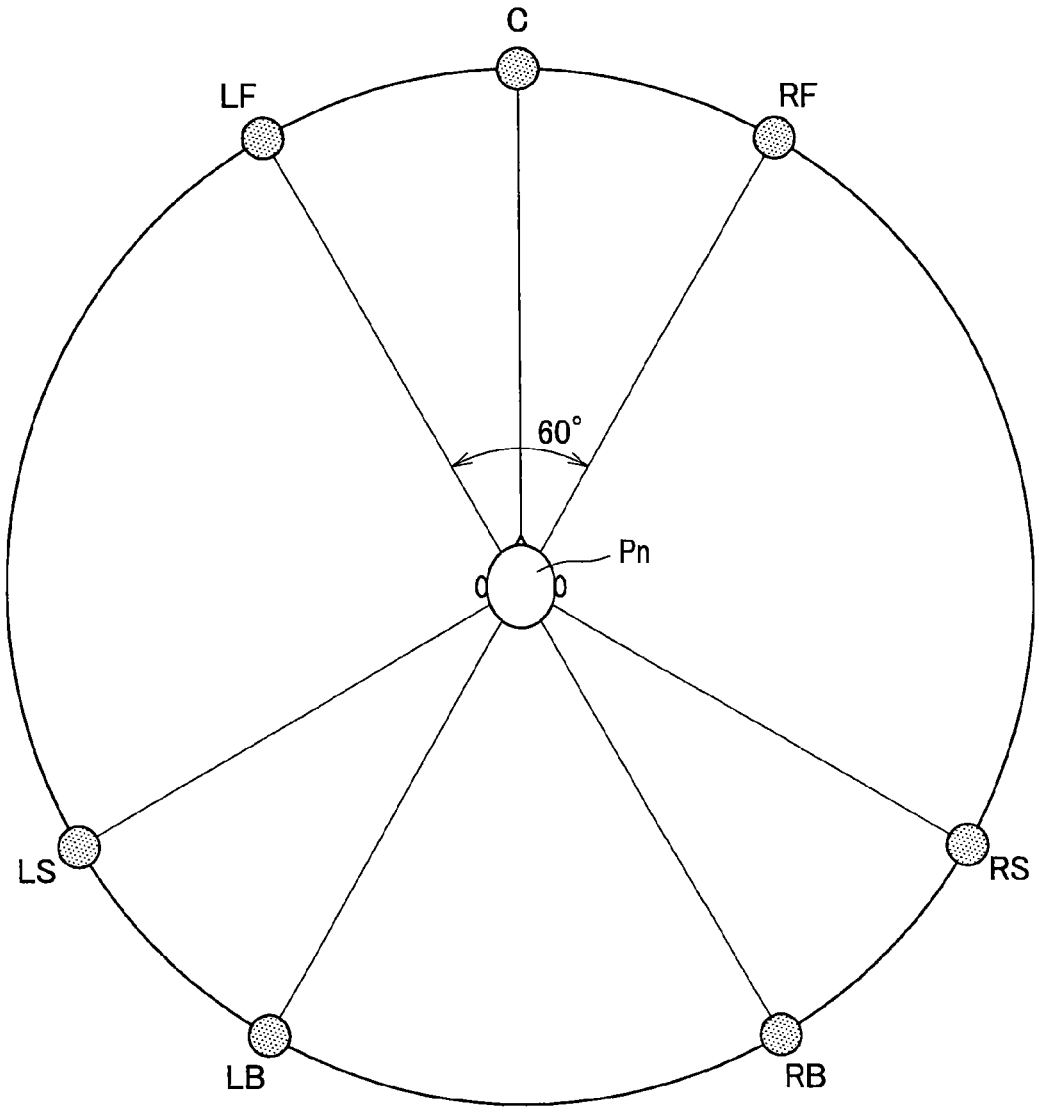
FIG. 1 is an explanatory diagram illustrating an example of speaker arrangement for 7.1-channel multichannel surround sound compliant with the international telecommunications union radiocommunication sector (ITU-R).

First, an example of speaker arrangement for multichannel surround sound will be described with reference to the drawings. FIG. 1 is an explanatory diagram illustrating the example of speaker arrangement for 7.1 channel multichannel surround sound compliant with the international telecommunications union radiocommunication sector (ITU-R), which is an example of multichannel surround sound. The example of speaker arrangement of the 7.1 channel multichannel surround sound will be described below with reference to FIG. 1.

The example of speaker arrangement of the 7.1 channel multichannel surround sound compliant with ITU-R is defined, as illustrated in FIG. 1, such that speakers of respective channels are positioned on a circle around a listener position Pn.

In FIG. 1, a front position C of the listener Pn is the speaker position of a center channel. Positions LF and RF, which are positioned on opposite sides across the speaker position C of the center channel and are away from each other by an angle range of 60 degrees, represent the speaker positions of a left front channel and a right front channel, respectively.

Then, two speaker positions LS and LB, and two speaker positions RS and RB are set on the right and left sides of the front position C of the listener Pn within a range from 60 degrees to 150 degrees. These speaker positions LS and LB, and RS and RB are set at positions symmetrical with respect to the listener. The speaker positions LS and RS are the speaker positions of a left side channel and a right side channel, and the speaker positions LB and RB are the speaker positions of a left rear channel and a right rear channel.

In this example of a sound reproduction system, headphones having headphone drivers disposed one by one for each of the headphones for the right and left ears of the listener Pn, are used as over ear headphones.

In this embodiment, when multichannel surround sound audio signals in 7.1 channels are subjected to sound reproduction by the over ear headphones of this example, the sound reproduction is performed considering the directions toward the speaker positions C, LF, RF, LS, RS, LB, and RB in FIG. 1 to be virtual sound image localization directions. Thus, in such manner as will be described hereafter, a selected head-related transfer function is convolved with the audio signal of each channel of the multichannel surround sound audio signals in 7.1 channels.

Note that the following description will be made on the basis of the 7.1-channel multichannel surround sound illustrated in FIG. 1, but the multichannel surround sound of the present disclosure is not limited to such an example. For example, 5.1 channel multichannel surround sound has a speaker arrangement in which speakers positioned at the speaker positions LB and RB are removed from the speaker arrangement of the 7.1-channel multichannel surround sound illustrated in FIG. 1.

The example of speaker arrangement in 7.1-channel multichannel surround sound is described above with reference to FIG. 1. Next, a configuration example of an audio signal processing device according to an embodiment of the present disclosure will be described.

[Configuration Example of Audio Signal Processing Device]

Figure 2:
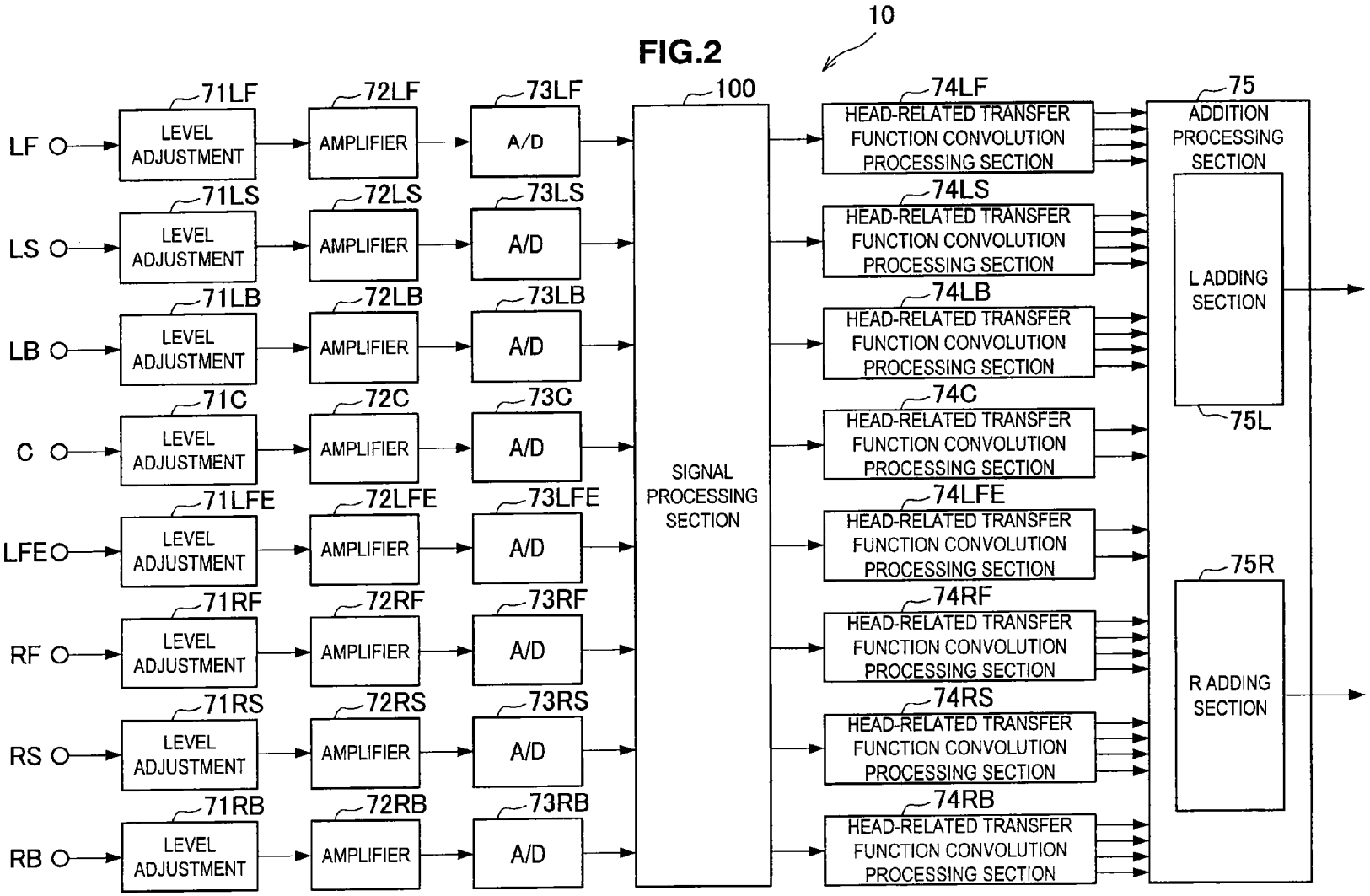
FIG. 2 is an explanatory diagram illustrating a configuration example of an audio signal processing device 10 according to an embodiment of the present disclosure.
Figure 3:
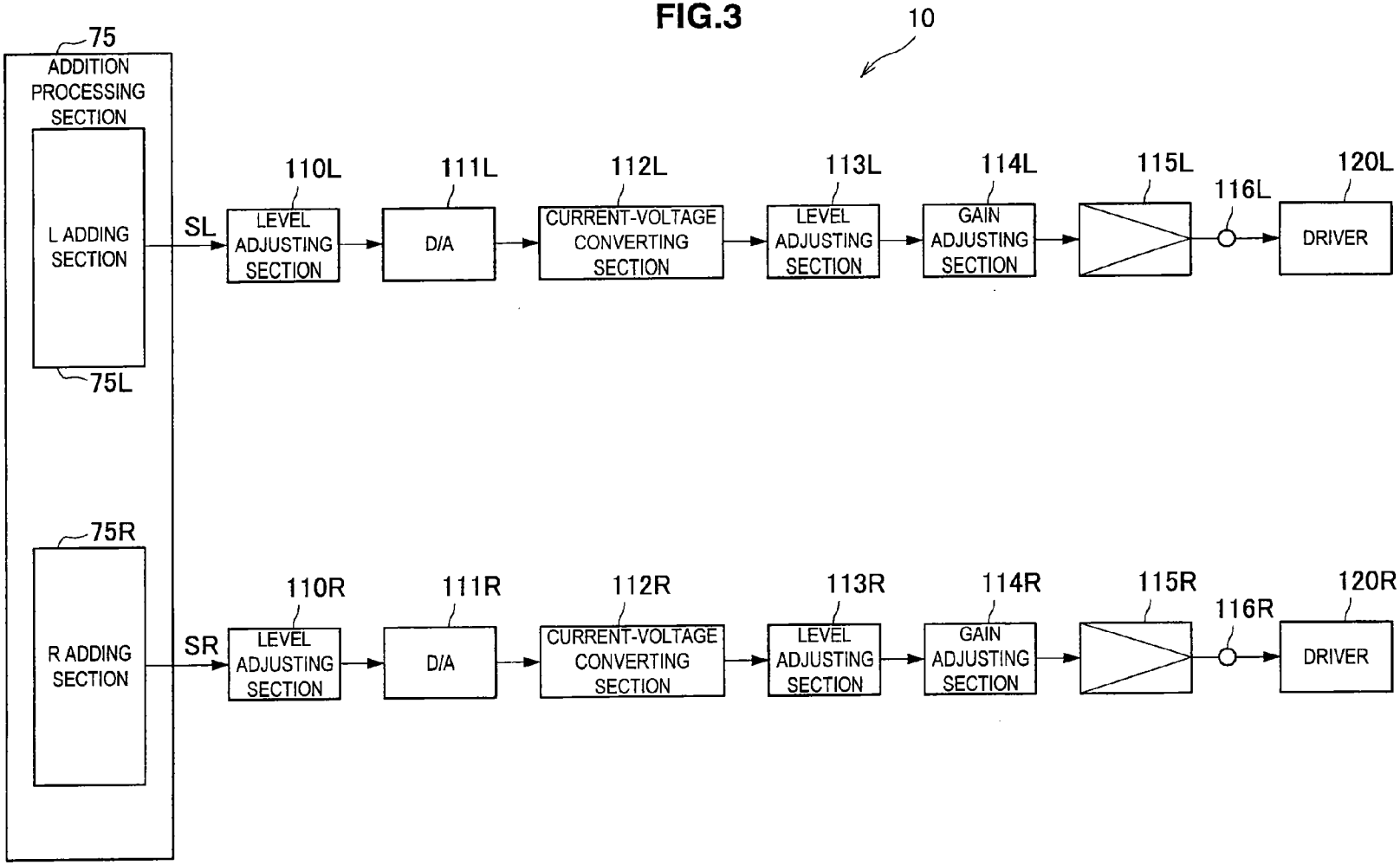
FIG. 3 is an explanatory diagram illustrating a configuration example of the audio signal processing device 10 according to an embodiment of the present disclosure.

FIG. 2 and FIG. 3 are explanatory diagrams illustrating a configuration example of an audio signal processing device 10 according to an embodiment of the present disclosure. The configuration example of the audio signal processing device 10 according to an embodiment of the present disclosure will be described below with reference FIG. 2 and FIG. 3.

The example illustrated in these FIG. 2 and FIG. 3 is an example of the case where electroacoustic transducing means for converting electric signals to bring sound to the ear of the listener Pn is 2-channel stereo over ear headphones including a headphone driver 120L for a left channel and a headphone driver 120R for a right channel.

Note that, in these FIG. 2 and FIG. 3, the audio signals of the channels to be provided to the speaker positions C, LF, RF, LS, RS, LB, and RB in FIG. 1 are denoted by the same reference characters C, LF, RF, LS, RS, LB, and RB. Here, in FIG. 2 and FIG. 3, an LFE channel refers to a low frequency effect channel and this is sound having no sound image localization direction that can be normally determined, and thus, in this example, this is considered to be an audio channel that is not to be convolved with a head-related transfer function.

As illustrated in FIG. 2, the 7.1-channel audio signals LF, LS, RF, RS, LB, RB, C, and LFE are provided to level adjusting sections 71LF, 71LS, 71RF, 71RS, 71LB, 71RB, 71C, and 71LFE, respectively, and the audio signals are subject to level adjustment.

The audio signals from these level adjusting sections 71LF, 71LS, 71RF, 71RS, 71LB, 71RB, 71C, and 71LFE are amplified by predetermined amounts by the amplifier 72LF, 72LS, 72RF, 72RS, 72LB, 72RB, 72C, and 72LFE and thereafter provided to A/D converters 73LF, 73LS, 73RF, 73RS, 73LB, 73RB, 73C, and 73LFE, respectively, to be converted into digital audio signals.

The digital audio signals from the A/D converters 73LF, 73LS, 73RF, 73RS, 73LB, 73RB, 73C, and 73LFE are subjected to signal processing, to be described hereafter, by a signal processing section 100 before provided to head-related transfer function convolution processing sections 74LF, 74LS, 74RF, 74RS, 74LB, 74RB, 74C, and 74LFE.

In each of the head-related transfer function convolution processing sections 74LF, 74LS, 74RF, 74RS, 74LB, 74RB, 74C, and 74LFE, in this example, a process of convolving direct waves and the reflected waves thereof with the head-related transfer function is performed using, for example, a convolution method disclosed in JP 2011-009842A.

In addition, in this example, each of the head-related transfer function convolution processing sections 74LF, 74LS, 74RF, 74RS, 74LB, 74RB, 74C, and 74LFE similarly performs the process of convolving the crosstalk components of the channels and the reflected waves thereof with the head-related transfer function using, for example, the convolution method disclosed in JP 2011-009842A.

Furthermore, in this example, it is assumed that the number of reflected waves to be processed by each of the head-related transfer function convolution processing sections 74LF, 74LS, 74RF, 74RS, 74LB, 74RB, 74C, and 74LFE is only one, for ease of description. It is needless to say that the number of reflected waves to be processed is not limited to such an example.

Output audio signals from the head-related transfer function convolution processing sections 74LF, 74LS, 74RF, 74RS, 74LB, 74RB, 74C, and 74LFE are provided to an addition processing section 75. The addition processing section 75 includes an adding section 75L for the left channel (hereafter, referred to as L adding section) and an adding section 75R for the right channel (hereafter, referred to as R adding section) of the 2-channel stereo headphones.

The L adding section 75L performs the addition of left channel components LF, LS, and LB that are essential and the reflected wave components thereof, the crosstalk components of right channel components RF, RS, and RB and the reflection components thereof, a center channel component C, and a low frequency effect channel component LFE.

Then, the L adding section 75L provides the result of the addition to, as illustrated in FIG. 3, a D/A converter 111L through a level adjusting section 110L, as a synthesized audio signal SL for a headphone driver 120L for the left channel.

The R adding section 75R performs the addition of the right channel components RF, RS, and RB that are essential and the reflected wave components thereof, the crosstalk components of the left channel components LF, LS, and LB and the reflection components thereof, the center channel component C, and the low frequency effect channel component LFE.

Then, the R adding section 75R provides the result of the addition to, as illustrated in FIG. 3, a D/A converting section 111R through a level adjusting section 110R, as a synthesized audio signal SR for a headphone driver 120R for the right channel.

In this example, the center channel component C and the low frequency effect channel component LFE are provided to both the L adding section 75L and the R adding section 75R and added to both the left channel and the right channel. It is thereby possible to further improve the sense of localization of sound in the direction of the center channel, and to reproduce the low frequency audio component by the low frequency effect channel component LFE further improving the expanse thereof.

In the D/A converters 111L and 111R, in such a manner as described above, the synthesized audio signal SL for the left channel and the synthesized audio signal SR for the right channel that are convolved with the head-related transfer function, are converted into analog audio signals.

The analog audio signals from these D/A converters 111L and 111R are provided to current-voltage converting sections 112L and 112R, respectively, to be converted from current signals into voltage signals.

Then, the audio signals from the current-voltage converting sections 112L and 112R, which are converted into voltage signals, are subjected to level adjustment by level adjusting sections 113L and 113R, and thereafter provided to gain adjusting sections 114L and 114R to be subjected to gain adjustment.

Then, output audio signals from the gain adjusting sections 114L and 114R are amplified by amplifiers 115L and 115R, and thereafter output to output terminals 116L and 116R of the audio signal processing device of an embodiment. The audio signals lead to these output terminals 116L and 116R are provided to the headphone driver 120L for a light ear and the headphone driver 12R for a right ear, respectively, to be subjected to sound reproduction.

In the audio signal processing device 10, according to this example, headphone drivers can reproduce a sound field in the 7.1-channel multichannel surround sound through virtual sound image localization, with the headphone drivers 120L and 120R one by one for left and right ears.

Here, at the time of performing the sound reproduction on audio signals in a multichannel surround sound system by 2-channel headphones using the head-related transfer function, when the environment of the speakers that are supposed to be disposed as illustrated FIG. 1 is merely simulated, it is difficult to reproduce sound quality and a sound field at the time of hearing with the speakers actually disposed as illustrated in FIG. 1. This is because, as described above, at the time of hearing with headphones, the headphones are firmly fixed on the head of a listener and sound is output from the vicinities of the ears of the listener, but at the time of hearing sound from speakers, the head of the listener is not necessarily fixed but moves slightly. Therefore, at the time of hearing the sound from speakers, the distances from the speakers to the ears of the listener and the angles (directions) to the speakers viewed from the listener are not constant, and thus, when the environment of the speakers is simply simulated, it is difficult to reproduce the sound quality and the sound field at the time of hearing with speakers similarly disposed.

Thus, in the present embodiment, by subjecting the 7.1-channel audio signals LF, LS, RF, RS, LB, RB, and C to signal processing in the signal processing section 100 illustrated in FIG. 2, sound quality and a sound field at the time of hearing with speakers actually disposed are reproduced at the time of reproducing the audio signals in the multichannel surround sound system, with 2-channel audio signals. Specifically, the signal processing section 100 mixes each of the 7.1-channel audio signals LF, LS, RF, RS, LB, RB, and C with slight audio signals of other channels and performs a process of causing a sound image to slightly fluctuate.

By subjecting the 7.1-channel audio signals LF, LS, RF, RS, LB, RB, and C to the signal processing with the signal processing section 100 in a stage prior to the convolution with the head-related transfer function, the audio signal processing device 10 can perform convolution signal processing, and can improve the sound quality or expand the sound field of virtual surround sound after mixing the audio signals to be output to the 2-channel stereo headphones.

As described above, the configuration example of the audio signal processing device 10 according to an embodiment the present disclosure has been described with reference to FIG. 2 and FIG. 3. Next, a configuration example of the signal processing section 100 included in the audio signal processing device 10 according to an embodiment of the present disclosure will be described.

[Configuration Example of Signal Processing Section]

FIG. 4A to FIG. 4G are explanatory diagrams illustrating a configuration example of the signal processing section 100 included in the audio signal processing device 10 according to an embodiment of the present disclosure. The configuration example of the signal processing section 100 included in the audio signal processing device 10 according to an embodiment of the present disclosure will be described below with reference to FIG. 4A to FIG. 4G.

Figure 4A:
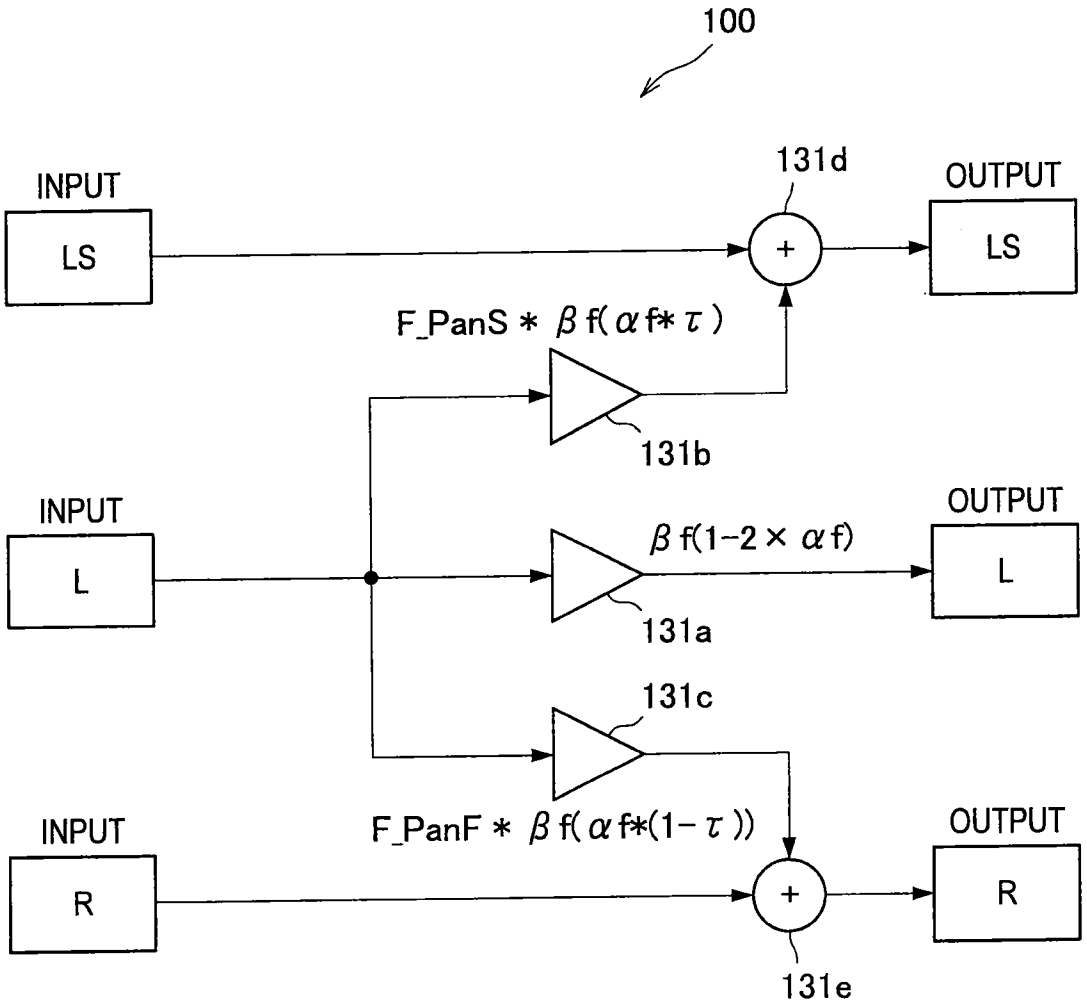
FIG. 4A is an explanatory diagram illustrating a configuration example of a signal processing section 100.

FIG. 4A to FIG. 4G illustrates the configuration example of the signal processing section 100 for performing signal processing on each of the 7.1-channel audio signals LF, LS, RF, RS, LB, RB, and C. For example, FIG. 4A illustrates a configuration for performing the above signal processing on L out of the 7.1-channel audio signals.

In the present embodiment, at the time of performing the signal processing with the signal processing section 100, in order to mix an audio signal with slight audio signals of other channels and to cause a sound image fluctuate slightly, two other audio signals that are positioned close to and at similar intervals from the audio signal are used.

For example, at the time of performing the above-described process on the signal of C, the signal processing section 100 uses the signals of L and R that are separated counterclockwise and clockwise by 30 degrees from the signal of C. In addition, at the time of performing the above-described process on the signal of L, the signal processing section 100 uses the signal of R clockwise away 60 degrees from the signal of L and the signal of LS counterclockwise away 90 degrees from the signal of L. Similarly, at the time of performing the above processing on the signal of R, the signal processing section 100 uses the signal of L counterclockwise away 60 degrees from the signal of R and the signal of RS clockwise away 90 degrees from the signal of R.

In addition, at the time of performing the above-described process on the signal of LS, the signal processing section 100 uses, for example, the signal of L 90 degrees clockwise away from the signal of LS and the signal of RS 120 degrees counterclockwise away from the signal of LS. Here, the signal processing section 100 uses the signal of RS 120 degrees counterclockwise away from the signal of LS rather than the signal of RB 90 degrees counterclockwise away from the signal of LS because the signal of RB does not exist in 5.1-channel multichannel surround sound. Similarly, at the time of performing the above-described process on the signal of RS, the signal processing section 100 uses the signal of R 90 degrees counterclockwise away from the signal of RS and the signal of LS 120 degrees clockwise away from the signal of RS. Also here, the signal processing section 100 uses the signal of LS 120 degrees clockwise away from the signal of RS rather than the signal of LB 90 degrees clockwise away from the signal of RS because the signal of LB does not exist in the 5.1-channel multichannel surround sound.

In addition, for example, at the time of performing the above-described process on the signal of LB, the signal processing section 100 uses the signal of LS 30 degrees clockwise away from the signal of LB and the signal of RB 60 degrees counterclockwise away from the signal of LB. Similarly, at the time of performing the above-described process on the signal of RB, the signal processing section 100 uses the signal of RS 30 degrees counterclockwise away from the signal of RB and the signal of LB 60 degrees clockwise away from the signal of RB.

In such a manner, the signal processing section 100 performs a process of slightly fluctuating the sound image on each audio signal using the above-described other two audio signals. By causing the sound image to fluctuate slightly, the audio signal processing device 10 can improve the sound quality and the sound field at the time of reproducing the audio signals in the multichannel surround sound system with the 2-channel audio signal.

Then, the signal processing section 100 synchronizes the fluctuation of the sound image across all the channels. In other words, the signal processing section 100 causes sound image localization positions to fluctuate so as to behave in the same way across all the channels. The audio signal processing device 10 can thereby reproduce the sound quality and the sound field at the time of hearing with speakers in the multichannel surround sound system actually disposed.

FIG. 4A illustrates amplifiers 131*a*, 131*b*, and 131*c* and adders 131*d* and 131*e*. The amplifiers 131*a*, 131*b*, and 131*c* each amplify the signal of L out of the 7.1-channel audio signals by a predetermined amount, and output the resultant signal.

The amplifier 131*a* amplifies the signal of L by $\beta f(1-2\times\alpha f)$. As the values of $\alpha f$ and $\beta f$, those which will be described hereafter are used. In addition, the amplifier 131*b* amplifies the signal of L by $F_PanS*\beta f(\alpha f*\tau)$. Similarly, the amplifier 131*c* amplifies the signal of L by $F_PanF*\beta f(\alpha f*(1-\tau))$. Note that $\tau$ ranges between 0 and 1, being a value that varies on a predetermined cycle. In addition, as the values of F_PanS and F_PanF, those which will be described hereafter are used. Note that $\alpha f$, $\beta f$, $\tau$, F_PanS, and F_PanF are parameters to fluctuate the virtual sound image localization position with respect to the signal of L. This applies also to the following parameters.

The adder 131*d* adds the signal of LS to the signal of L amplified by the amplifier 131*b* and outputs the resultant signal. Similarly, the adder 131*e* adds the signal of RS to the signal of L amplified by the amplifier 131*c* and outputs the resultant signal. The signals amplified and added in such a manner by the signal processing section 100 are signals to be subjected to the processing of convolving the head-related transfer function.

Figure 4B:
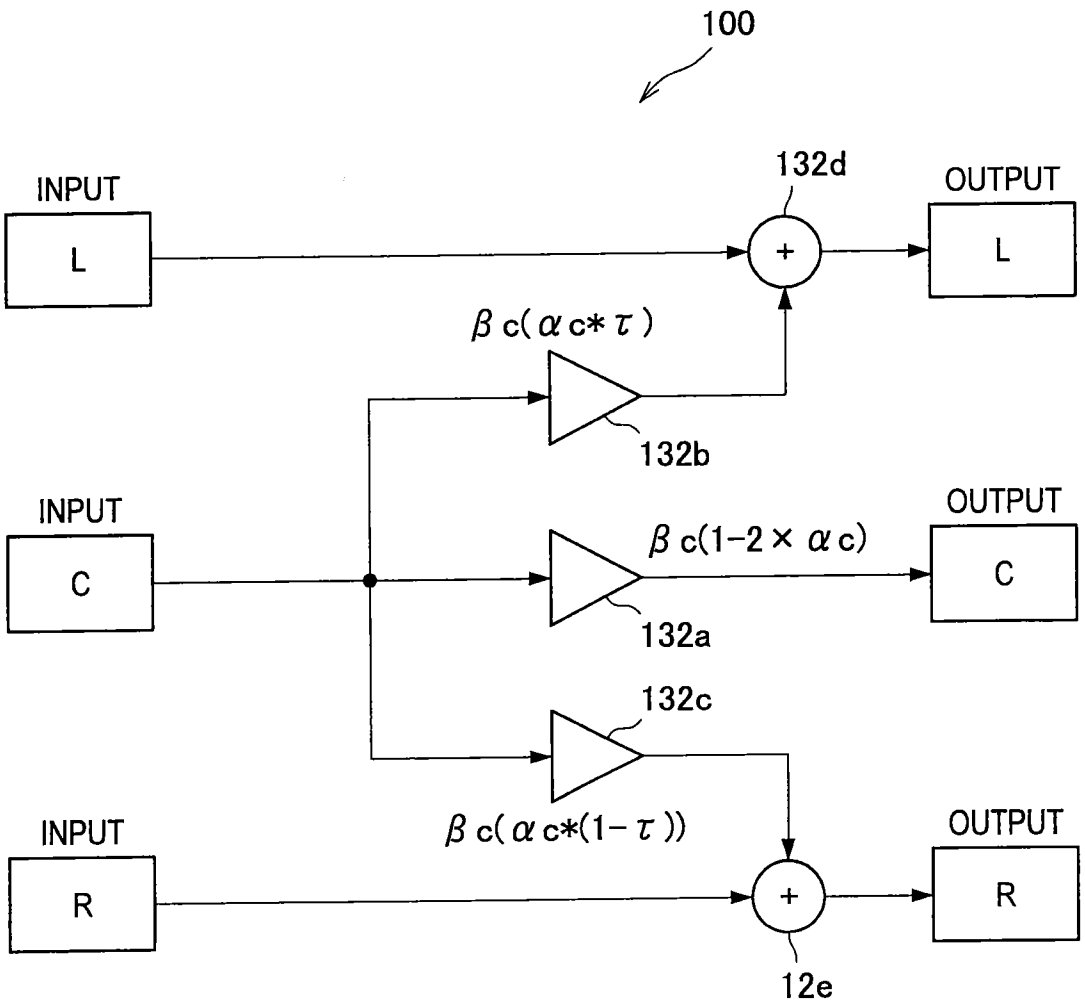
FIG. 4B is an explanatory diagram illustrating a configuration example of the signal processing section 100.

FIG. 4B illustrates amplifiers 132*a*, 132*b*, and 132*c* and adders 132*d* and 132*e*. The amplifiers 132*a*, 132*b*, and 132*c* each amplify the signal of C out of the 7.1-channel audio signals by a predetermined amount, and output the resultant signal.

The amplifier 132*a* amplifies the signal of C by $\beta c(1-2\times\alpha c)$. As the values of $\alpha c$ and $\beta c$, those which will be described hereafter are used. In addition, the amplifier 132*b* amplifies the signal of C by $\beta c(\alpha c*\tau)$. Similarly, the amplifier 132*c* amplifies the signal of C by $\beta c(\alpha c*(1-\tau))$.

The adder 132*d* adds the signal of L to the signal of C amplified by the amplifier 132*b* and outputs the resultant signal. Similarly, the adder 132*e* adds the signal of R to the signal of C amplified by the amplifier 132*c* and outputs the resultant signal. The signals amplified and added in such a manner by the signal processing section 100 are signals to be subjected to the processing of convolving the head-related transfer function.

Figure 4C:
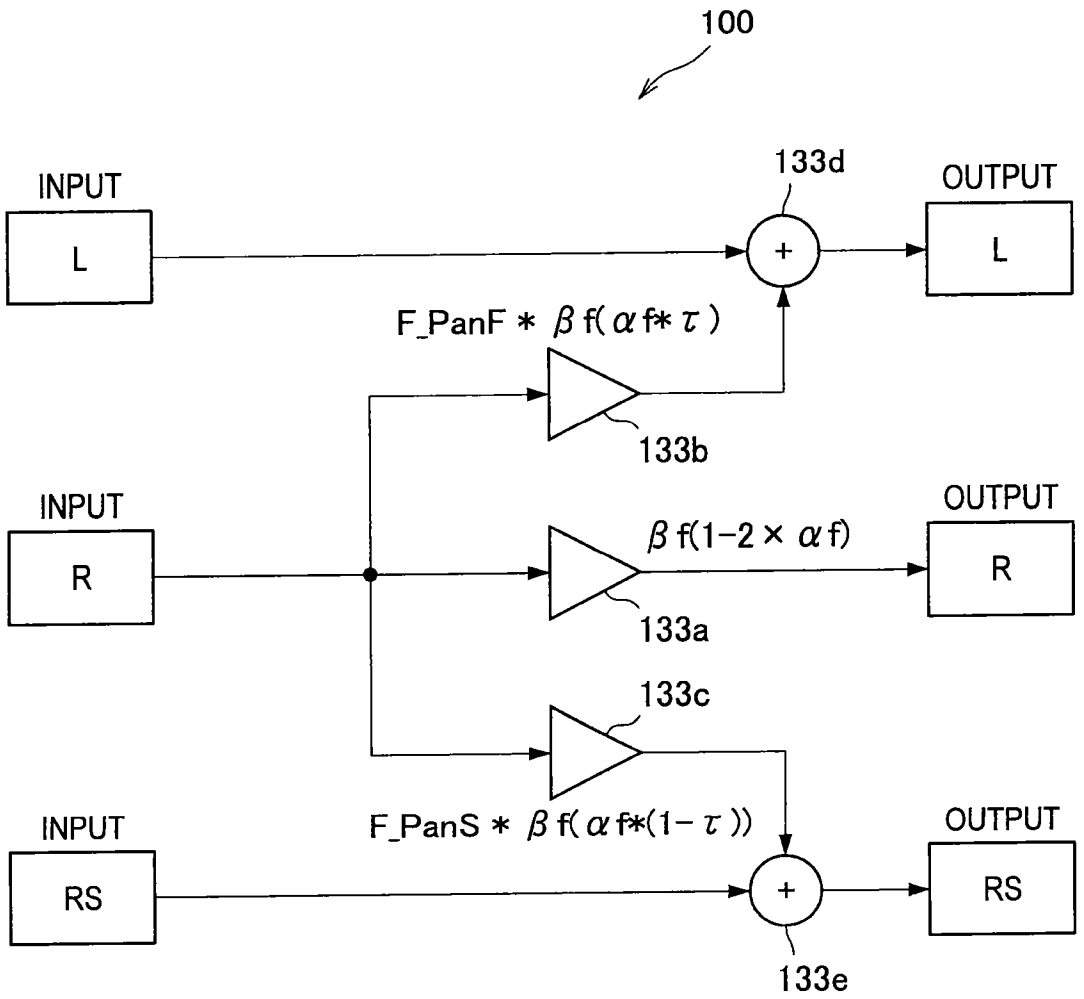
FIG. 4C is an explanatory diagram illustrating a configuration example of the signal processing section 100.

FIG. 4C illustrates amplifiers 133*a*, 133*b*, and 133*c* and adders 133*d* and 133*e*. The amplifiers 133*a*, 133*b*, and 133*c* each amplify the signal of R out of the 7.1-channel audio signals by a predetermined amount, and output the resultant signal.

The amplifier 133*a* amplifies the signal of R by $\beta f(1-2\times\alpha f)$. As the values of $\alpha f$ and $\beta f$, those which will be described hereafter are used. In addition, the amplifier 133*b* amplifies the signal of R by $F_PanF*\beta f(\alpha f*\tau)$. Similarly, the amplifier 133*c* amplifies the signal of R by $F_PanS*\beta f(\alpha f*(1-\tau))$.

The adder 133*d* adds the signal of L to the signal of R amplified by the amplifier 133*b* and outputs the resultant signal. Similarly, the adder 133*e* adds the signals RS to the signal of R amplified by the amplifier 133*c* and outputs the resultant signal. The signals amplified and added in such a manner by the signal processing section 100 are signals to be subjected to the processing of convolving the head-related transfer function.

Figure 4D:
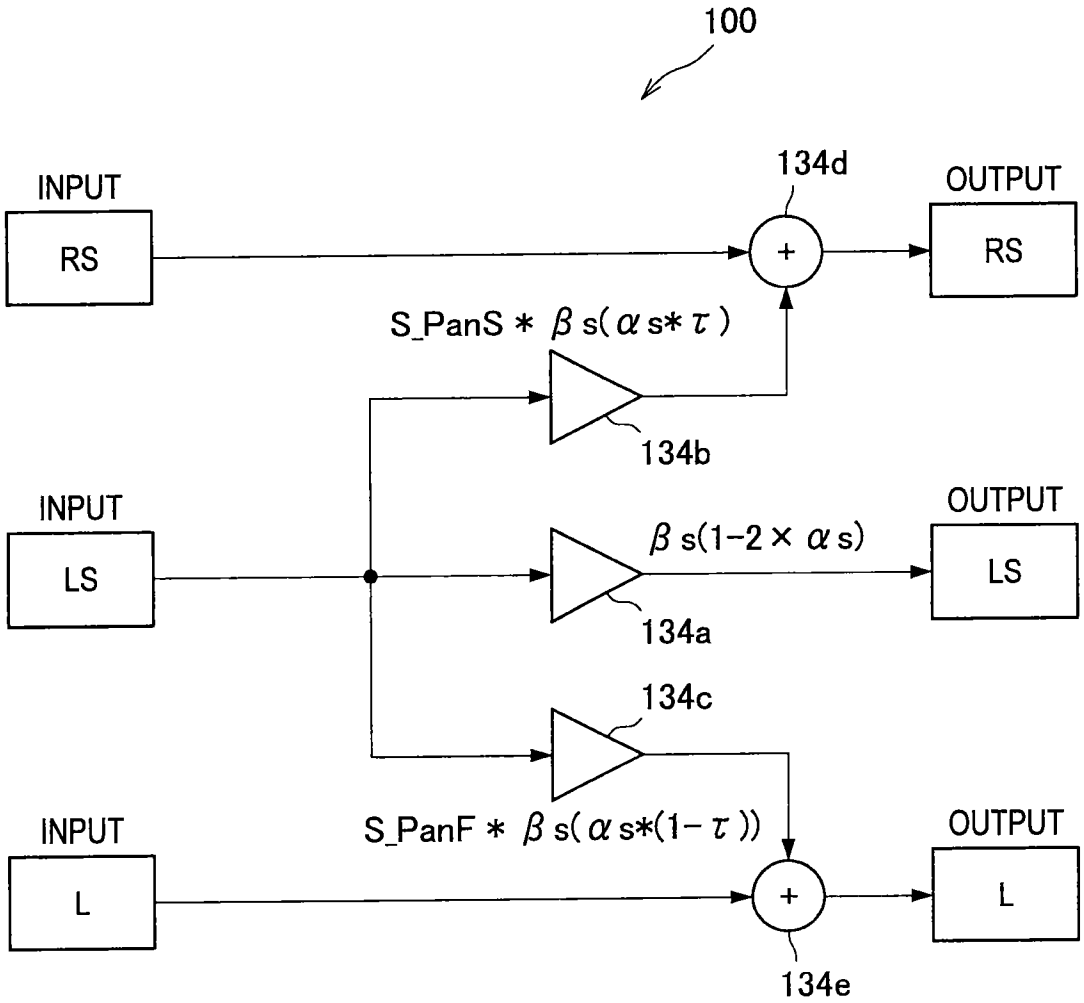
FIG. 4D is an explanatory diagram illustrating a configuration example of the signal processing section 100.

FIG. 4D illustrates amplifier 134*a*, 134*b*, and 134*c* and adders 134*d* and 134*e*. The amplifiers 134*a*, 134*b*, and 134*c* each amplify the signal of LS out of the 7.1-channel audio signals by a predetermined amount, and output the resultant signal.

The amplifier 134*a* amplifies the signal of LS by $\beta s(1-2\times\alpha s)$. As the values of $\alpha s$ and $\beta s$, those which will be described hereafter are used. In addition, the amplifier 134*b* amplifies the signal of LS by $S_PanS*\beta s(\alpha s*\tau)$. Similarly, the amplifier 134*c* amplifies the signal of LS by $S_PanF*\beta s(\alpha s*(1-\tau))$.

The adder 134*d* adds the signal of RS to the signal of LS amplified by the amplifier 134*b* and outputs the resultant signal. Similarly, the adder 134*e* adds the signal of L to the signals LS amplified by the amplifier 134*c* and outputs the resultant signal. The signals amplified and added in such a manner by the signal processing section 100 are signals to be subjected to the processing of convolving the head-related transfer function.

Figure 4E:
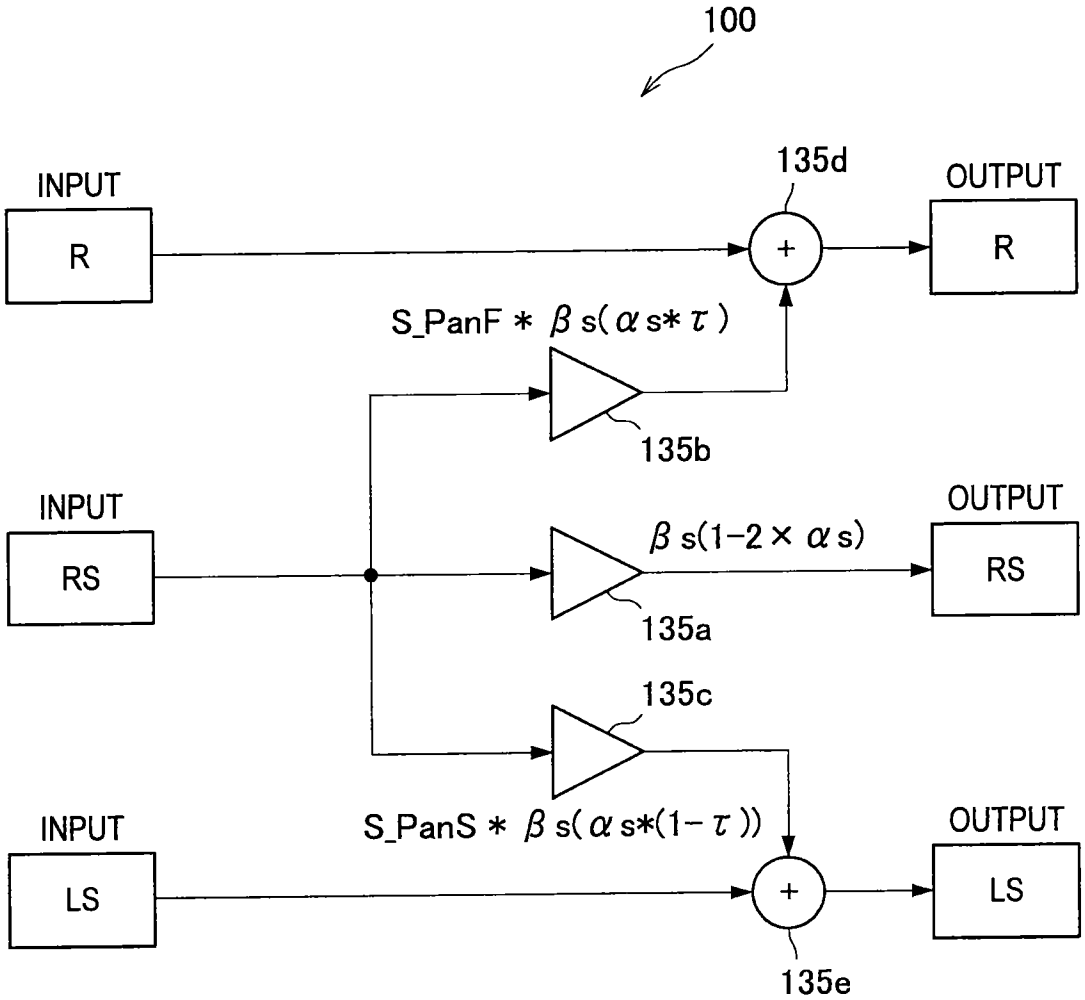
FIG. 4E is an explanatory diagram illustrating a configuration example of the signal processing section 100.

FIG. 4E illustrates amplifiers 135*a*, 135*b*, and 135*c* and adders 135*d* and 135*e*. The amplifier 135*a*, 135*b*, and 135*c* each amplify the signal of RS out of the 7.1-channel audio signals by a predetermined amount, and output the resultant signal.

The amplifier 135*a* amplifies the signal of RS by $\beta s(1-2\times\alpha s)$. As the values of $\alpha s$ and $\beta s$, those which will be described hereafter are used. In addition, the amplifier 135*b* amplifies the signal of RS by $S_PanF*\beta s(\alpha s*\tau)$. Similarly, the amplifier 135*c* amplifies the signal of RS by $S_PanS*\beta s(\alpha s*(1-\tau))$.

The adder 135*d* adds the signal of R to the signal of RS amplified by the amplifier 135*b* and outputs the resultant signal. Similarly, the adder 135*e* adds the signal of LS to the signal of RS amplified by the amplifier 135*c* and outputs the resultant signal. The signals amplified and added in such a manner by the signal processing section 100 are signals to be subjected to the processing of convolving the head-related transfer function.

Figure 4F:
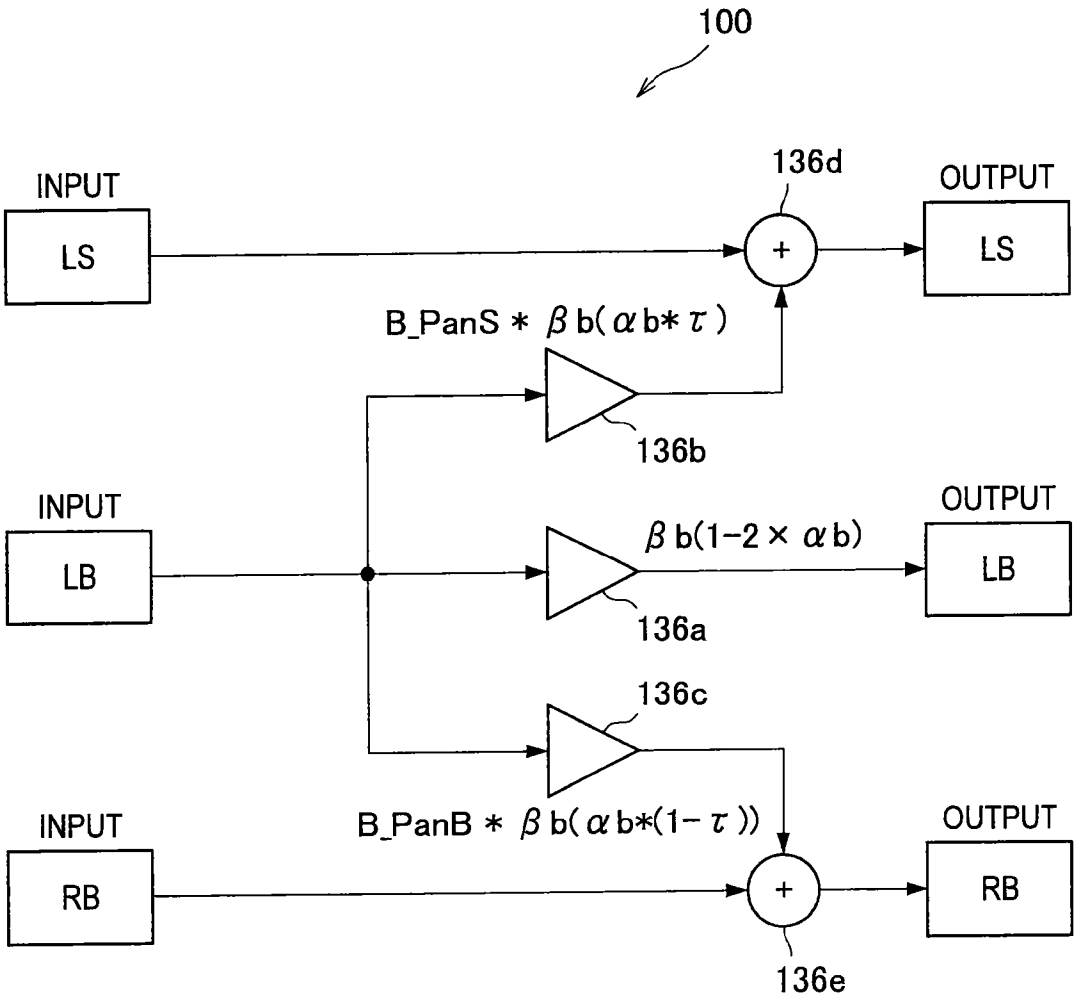
FIG. 4F is an explanatory diagram illustrating a configuration example of the signal processing section 100.

FIG. 4F illustrates amplifier 136*a*, 136*b*, and 136*c* and adders 136*d* and 136*e*. The amplifiers 136*a*, 136*b*, and 136*c* each amplify the signal of LB out of the 7.1-channel audio signals by a predetermined amount, and output the resultant signal.

The amplifier 136*a* amplifies the signal of LB by $\beta b(1-2\times\alpha b)$. As the values $\alpha b$ and $\beta b$, those which will be described hereafter are used. In addition, the amplifier 136*b* amplifies the signal of LB by $B_PanS*\beta b(\alpha b*\tau)$. Similarly, the amplifier 136*c* amplifies the signal of LB by $B_PanB*\beta b(\alpha b*(1-\tau))$.

The adder 136*d* adds the signal of LS to the signal of LB amplified by amplifier 136*b* and outputs the resultant signal. Similarly, the adder 136*e* adds the signal of RB to the signal of LB amplified by the amplifier 136*c* and outputs the resultant signal. The signals amplified and added in such a manner by the signal processing section 100 are signals to be subjected to the processing of convolving the head-related transfer function.

Figure 4G:
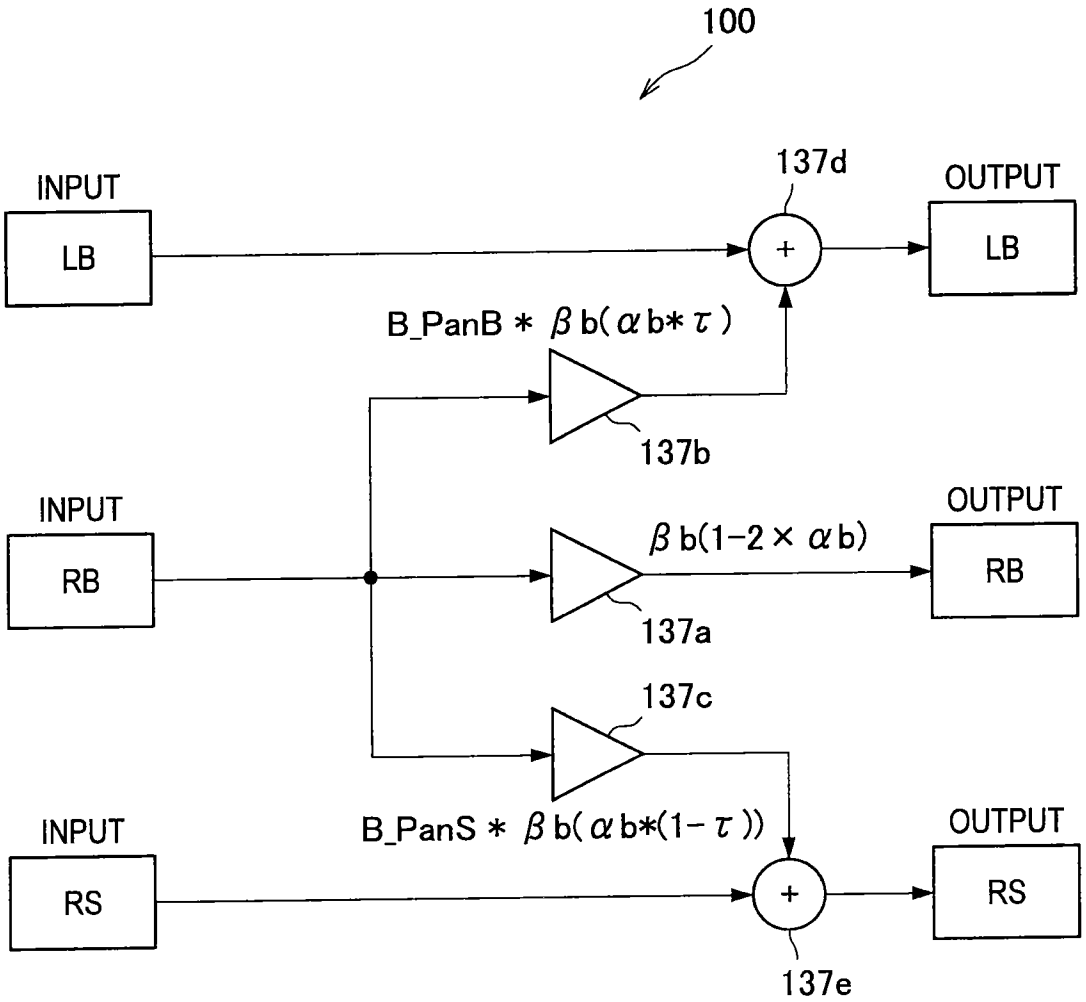
FIG. 4G is an explanatory diagram illustrating a configuration example of the signal processing section 100.

FIG. 4G illustrates amplifiers 137*a*, 137*b*, and 137*c* and adder 137*d* and 137*e*. The amplifiers 137*a*, 137*b*, and 137*c* each amplify the signal of RB out of the 7.1-channel audio signals by a predetermined amount, and output the resultant signal.

The amplifier 137*a* amplifies the signal of RB by $\beta b(1-2\times\alpha b)$. As the values of $\alpha b$ and $\beta b$, those which will be described hereafter are used. In addition, the amplifier 137*b* amplifies the signal of RB by $B_PanB*\beta b(\alpha b*\tau)$. Similarly, the amplifier 137*c* amplifies the signal of RB by $B_PanS*\beta b(\alpha b*(1-\tau))$.

The adder 137*d* adds the signal of LB to the signal of RB amplified by the amplifier 137*b* and outputs the resultant signal. Similarly, the adder 137*e* adds the signal of RS to the signal of RB amplified by the amplifier 137*c* and outputs the resultant signal. The signals amplified and added in such a manner by the signal processing section 100 are signals to be subjected to the process of convolving the head-related transfer function.

As the above-described βc, αc, βf, αf, βs, αs, βb, and αb, the following values are used.

βc is approximately equal to 1.0
αc is approximately equal to 0.1
βf is approximately equal to 1.0
αf is approximately equal to 0.1
βs is approximately equal to 1.0
αs is approximately equal to 0.1*(60.0/210.0)
βb is approximately equal to 1.0
αb is approximately equal to 0.1*(60.0/90.0)

The above-described parameters are on the basis of the distribution of the signal of C, and defined on the assumption that the input signals fluctuate with the same sound image. With respect to each channel other than the signal of C, correction is made in conformity with the angles of speakers to which the channel is distributed.

In addition, the following parameters F_PanF, F_PanS, S_PanF, S_PanS, B_PanS, and B_PanB relate to signals that cannot be distributed with the same angle, the parameters used for performing angle correction including correction by hearing at the time of the distribution. How to distribute a signal that cannot be distributed with the same angle will be described hereafter.

F_Pan is approximately equal to 0.05
F_PanF=(1.0+F_Pan)
F_PanS=(1.0−F_Pan)
S_Pan=(F_Pan*(150.0/210.0))
S_PanF=(1.0+S_Pan)
S_PanS=(1.0−S_Pan)
B_Pan=(F_Pan*(150.0/90.0))
B_PanS=(1.0+B_Pan)
B_PanB=(1.0−B_Pan)

Here, those parameters shown with "is approximately equal to" are intended to indicate that values that are approximate to these may be used therefor. In practice, by varying these parameters a little from the above-described values, the audio signal processing device 10 can perform convolution signal processing, and can improve sound quality or expand the sound field of the virtual surround sound after mixing the audio signals to be output to the 2-channel stereo headphones.

The respective audio signals distributed in such a manner are distributed cyclically with τ ranging between 0 and 1 so as to have the same rotation in accordance with τ according to the same speaker arrangement. The cycle of this τ includes, for example, a fixed pattern and a pattern to randomly distribute. These patterns will be described hereafter.

As described above, the configuration example of the signal processing section 100 included in the audio signal processing device 10 according to an embodiment of the present disclosure has been described with reference to FIG. 4A to FIG. 4G. Next, the operation of the audio signal processing device 10 according to an embodiment of the present disclosure will be described.

[Operation Example of Audio Signal Processing Device]

Figure 5:
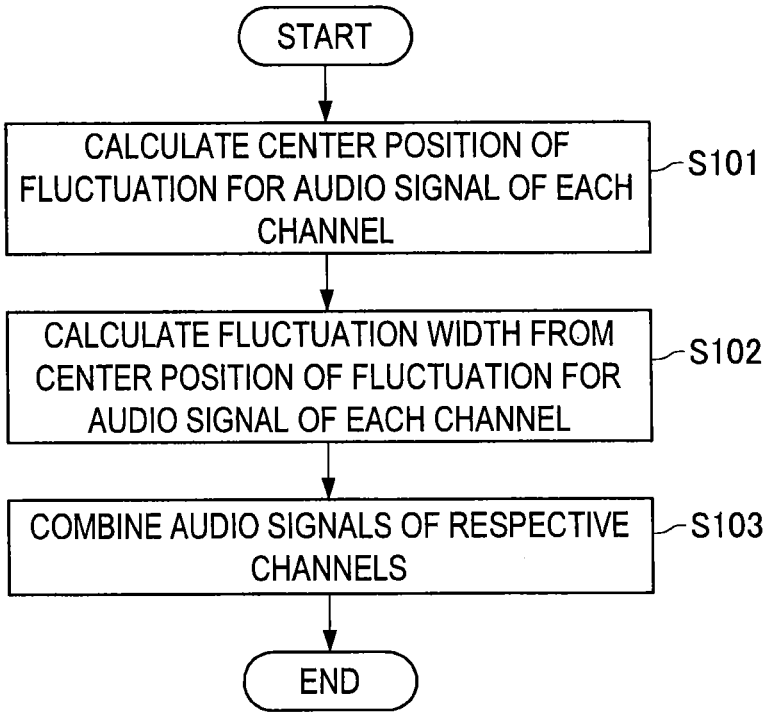
FIG. 5 is a flow chart illustrating an operation example of an audio signal processing device 10 according to an embodiment of the present disclosure.

FIG. 5 is a flow chart illustrating an operation example of the audio signal processing device 10 according to an embodiment of the present disclosure. The flow chart illustrated in FIG. 5 represents an operation example of the audio signal processing device 10 at the time of performing an operation to control the localization positions of sound images with respect to audio signals in the multichannel surround sound system. The operation example of the audio signal processing device 10 according to an embodiment of the present disclosure will be described below with reference to FIG. 5.

First, in the signal processing section 100, with respect to the audio signal of each channel in the multichannel surround sound system, the center position of fluctuation is calculated (step S101). In the processing of step S101, after calculating the center position of fluctuation with respect to the audio signal of each channel, the signal processing section 100 subsequently calculates the width of fluctuation from the calculated center position of fluctuation with respect to the audio signal of each channel (step S102). Then, the signal processing section 100 causes the audio signal of each channel to fluctuate by the width of fluctuation calculated in step S102, before combining the audio signal of each channel with the audio signal of another channel (step S103).

At the time of causing the parameter τ to vary cyclically, the signal processing section 100 may cause the parameter τ to vary on a cycle close to a block size used in compressing audio data, which is hard for human ears to perceive. In addition, the signal processing section 100 may cause the parameter τ to vary on a random cycle. In addition, the signal processing section 100 may perform a control in such a manner as to cause the audio signal of each channel to fluctuate using the sum of multiplexed parameters t that are caused to vary on different cycles.

Figure 6A:
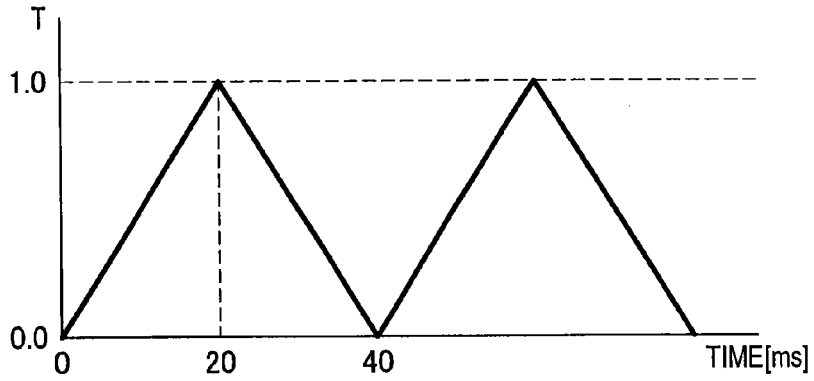
FIG. 6A is an explanatory diagram illustrating an example of variations in parameter at the time of causing an audio signal to fluctuate.
Figure 6B:
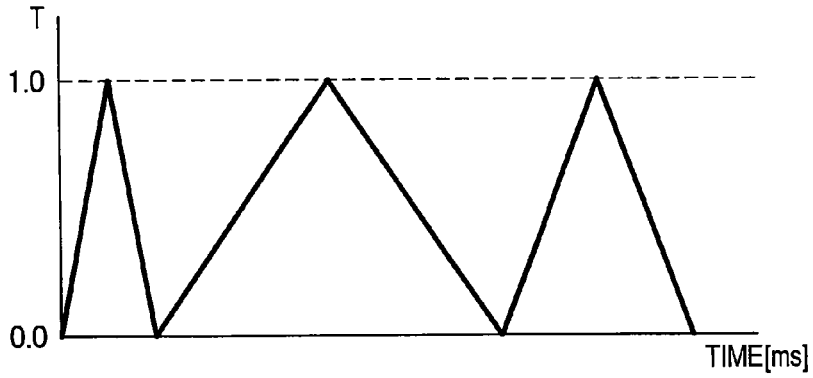
FIG. 6B is an explanatory diagram illustrating an example of variations in parameters at the time of causing an audio signal to fluctuate.

Here, the parameter τ used at the time of causing an audio signal to fluctuate will be described. FIG. 6A and FIG. 6B are explanatory diagrams illustrating examples of variations in parameter τ at the time of causing an audio signal to fluctuate. What is illustrated in FIG. 6A is the example of variations at the time of causing the parameter τ to vary cyclically illustrated in the form of a graph. In FIG. 6A, the parameter τ is caused to be in proportional to time on a cycle of 40 ms. In addition, what is illustrated in FIG. 6B is the example of variation at the time of causing the parameter τ to vary on a random cycle illustrated in the form of a graph.

With respect to the pattern in which the parameter τ is caused to randomly vary as illustrated in FIG. 6B, adding multiplexed random noises that range between −1 and +1 and have different cycles has a greater effect of improvement than making variations with a simple white noise (or M sequence). In addition, a larger number of random noises to be added (the added random noise closer to have a normal distribution) tends to have a greater effect of improvement. In other words, when a white noise (or M sequences) ranging between −1 and 1, which have no (little) correlation, is denoted by WN(n), $$n = 1:\ \tau = WN(0) + 1.0(\text{Random Noise})$$

$$n = 2:\ \tau = (WN(0) + WN(1))/2.0 + 1.0(\text{Triangular Distribution})$$

$$\vdots$$

$$n = 8:\ \tau = (WN(0) + \ldots + WN(7))/8.0 + 1.0(\text{Pseudo Normal Distribution})$$

it is thus confirmed that the sound quality and the sound field tend to be further improved as n becomes greater.

Figure 7:
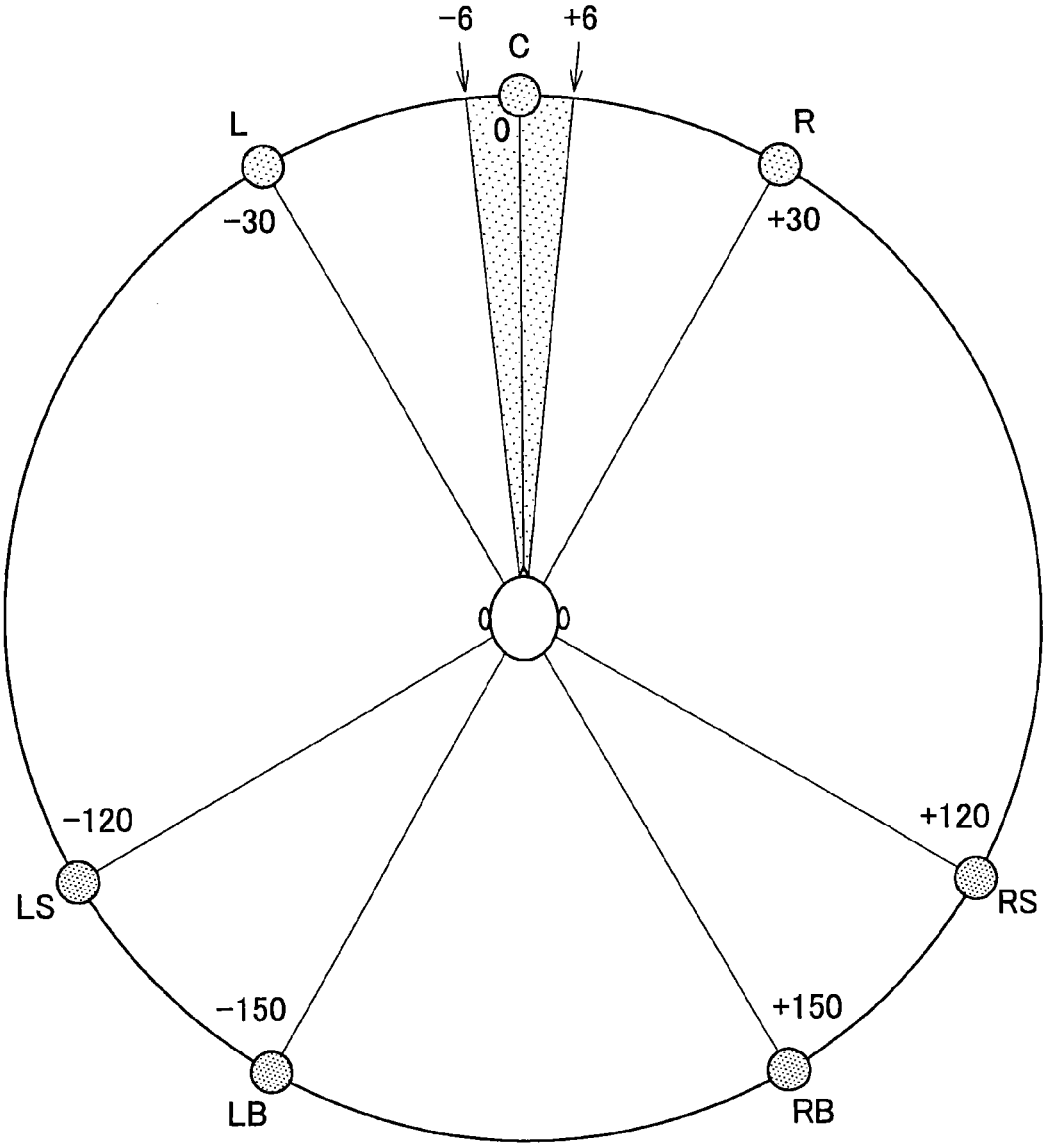
FIG. 7 is an explanatory diagram illustrating the width of fluctuation of the signal of C.

Subsequently, an example of the width of fluctuation and angle correction of the audio signal of each channel are illustrated. FIG. 7 is an explanatory diagram illustrating the width of fluctuation of the signal of C. The signal of C is split and distributed to a signal of L and a signal of R that are positioned at the right and left side and at regular intervals. The amounts of distribution are, for example, 80% for C and a width of between 0 and 20% for L and R. Thereby, the sound image localization position by the signal of C is to fluctuate clockwise and counterclockwise within a range of six degrees across the original sound image localization position by the signal of C. In other words, the above-described parameters $\alpha$ c and $\beta$c have the relationship in which one is ten times as much as another so as to cause the sound image localization position by the signal of C to fluctuate clockwise and counterclockwise within a range of six degrees, which is 1/10 of an interval of 60 degrees between L and R.

Figure 8:
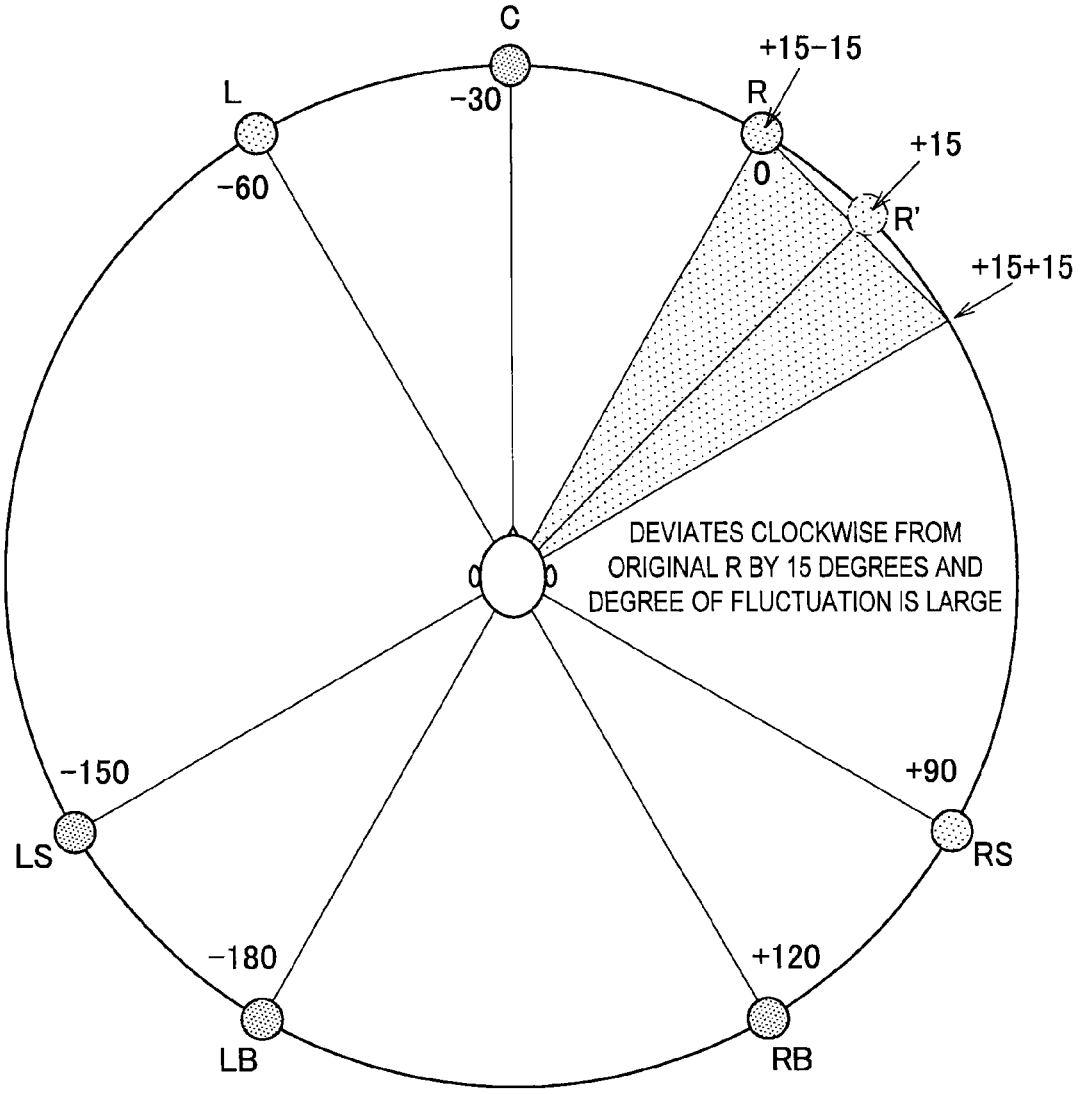
FIG. 8 is an explanatory diagram illustrating the width of fluctuation of the signal of R.

FIG. 8 is an explanatory diagram illustrating the width of fluctuation of the signal of R. The signal of R is split and distributed to a signal of L and a signal of RS that are positioned at the right and left but not at regular intervals. Therefore, to distribute the signal of R, the position of R is first temporality set at a position at which L and RS are positioned at regular intervals. In FIG. 8, the provisionally set position of R is denoted by R'. The position of R' is at a position deviating clockwise by 15 degrees from the position of R.

In addition, when the amounts of distribution are, as with the signal of C, 80% for R and a width of between 0 and 20% for L and RS, the sound image localization position by the signal of R' is to fluctuate clockwise and counterclockwise within a range of 15 degrees across the sound image localization position by the signal of R'. With this, the degree of fluctuation is so large that the fluctuation does not become the same as that of the signal of C. Therefore, as with the signal of C, the degree of fluctuation of the sound image localization position by the signal of R is adjusted such that the degree of fluctuation is within a range of six degrees each to the right and right.

Figure 9:
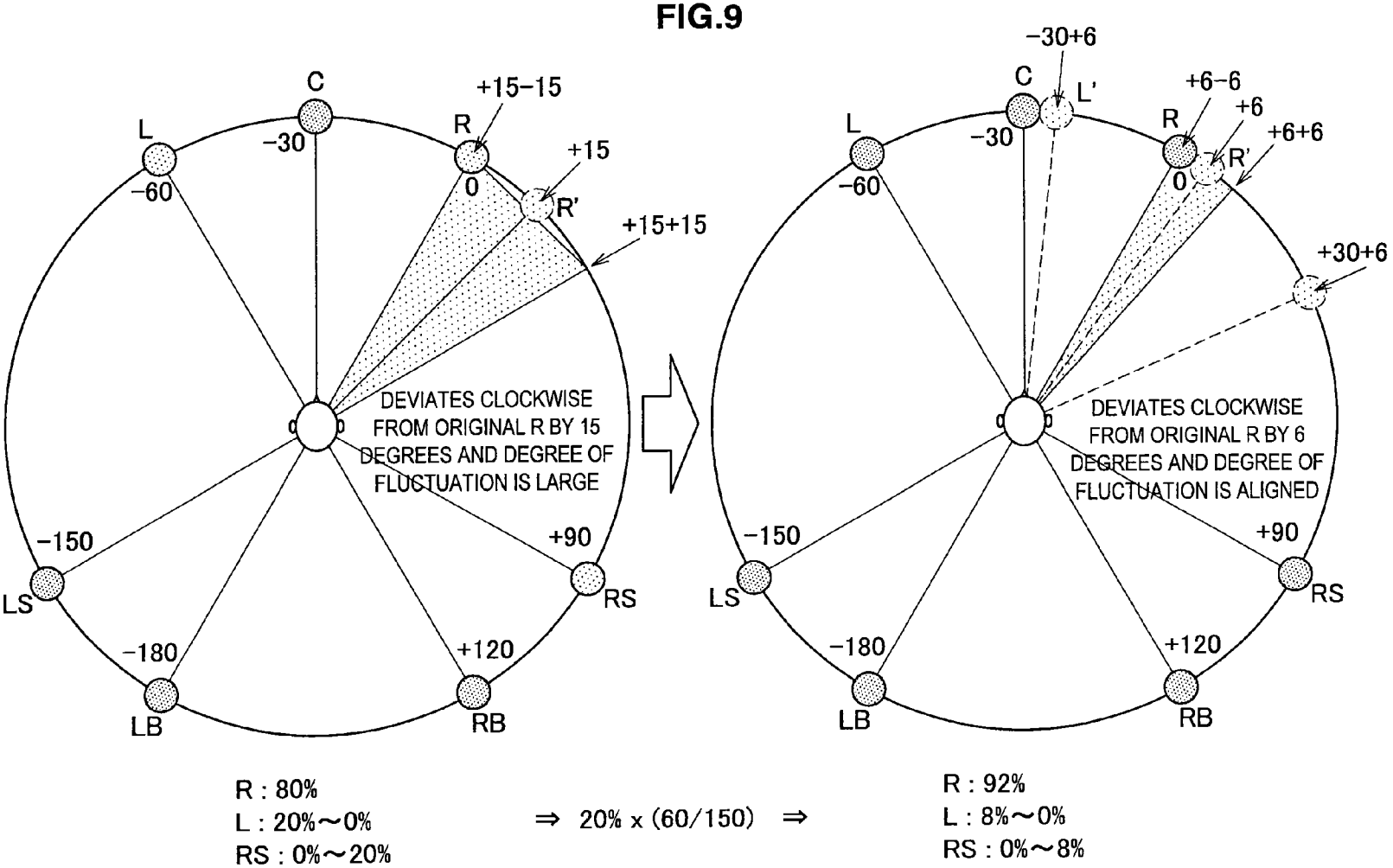
FIG. 9 is an explanatory diagram illustrating the width of fluctuation of the signal of R.

FIG. 9 is an explanatory diagram illustrating the width of fluctuation of the signal of R. FIG. 9 illustrates how to adjust the degree of fluctuation of the sound image localization position by the signal of R from 15 degrees to 6 degrees. The distribution of 80% for R and a width of between 0 and 20% for L and RS is changed into distribution of 92% for R and a width of between 0 and 8% for L and RS such that the degree of fluctuation becomes six degrees. This is a value obtained by multiplexing 20% distributed for L and RS by 60/150. In addition, as with the signal of C, by making the degree of fluctuation six degrees, the position of R' and the positions of L and RS to which the signal of R is distributed are changed into the positions of R', L' and RS' as illustrated on the right side of FIG. 9.

With this, the degree of fluctuation is adjusted into the width the same as that of the signal of C, but the sound image localization position by the signal of R deviates clockwise by six degrees from the original position, and it is thus necessary to align this sound image localization position with the original position.

Figure 10:
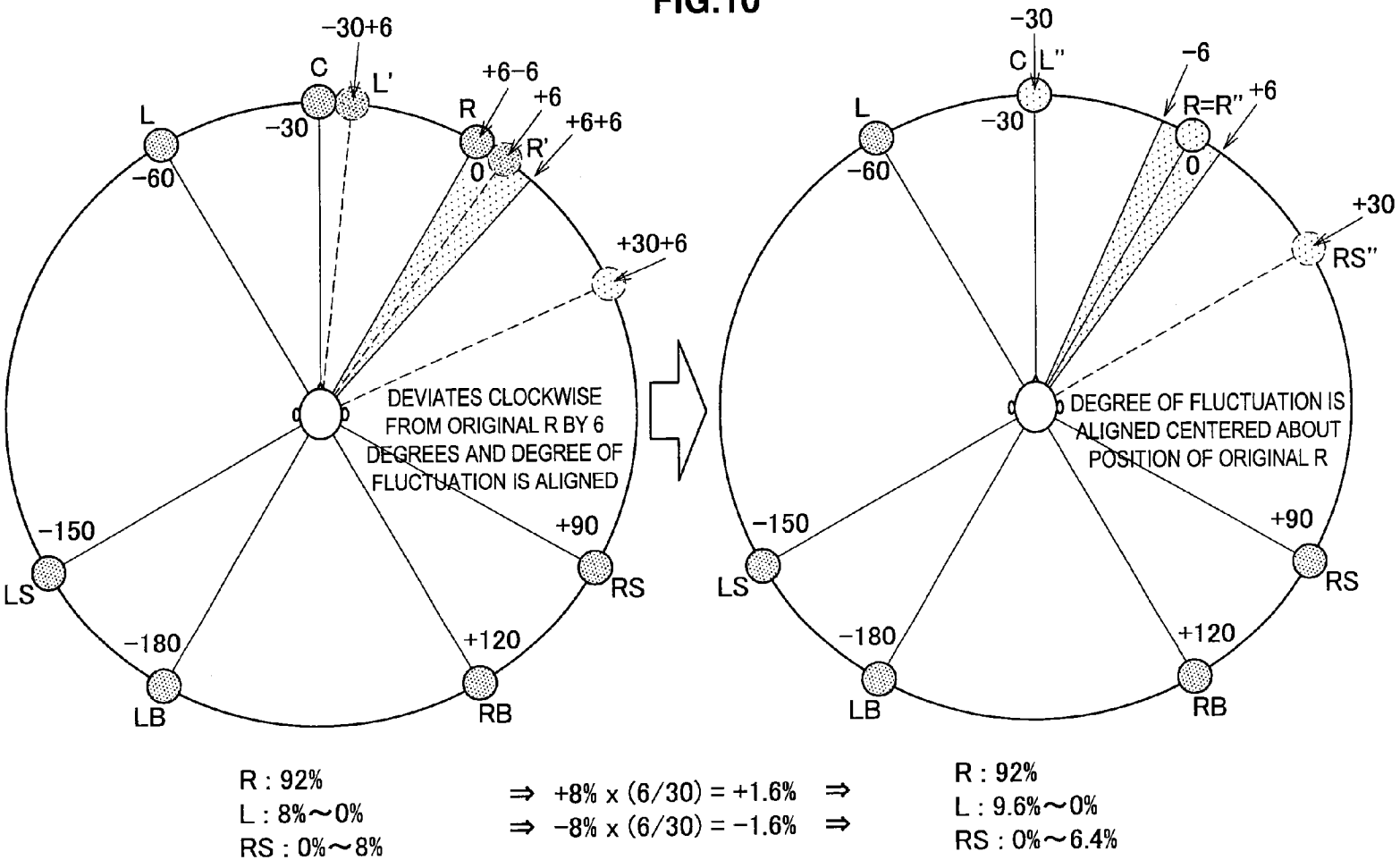
FIG. 10 is an explanatory diagram illustrating the width of fluctuation of the signal of R.

FIG. 10 is an explanatory diagram illustrating the width of fluctuation of the signal of R. FIG. 10 illustrates how to align the sound image localization position of the signal of R with the original position. By shifting the sound image localization position that deviates clockwise by six degrees, counterclockwise by six degrees, the sound image localization position of the signal of is aligned with the original position. In addition, the positions of L' and RS' are similarly shifted counterclockwise by six degrees. Thereby, the positions of R', L' and RS' are changed to the positions of R", L" and RS". Note that the position of R" is the same as the position of R.

To shift the position of U counterclockwise by six degrees, as illustrated in FIG. 10, a value obtained by multiplying the degree of fluctuation of 8% by 6/30 is added. In contrast, to shift the position of RS' counterclockwise by six degrees, as illustrated in FIG. 10, the value obtained by multiplying the degree of fluctuation of 8% by 6/30 is subtracted. The amounts of distribution are thereby changed to a width of between 0 and 9.6% for L and a width of between 0 and 6.4% for RS, although the amount of distribution for R remains at 92%.

By adjusting the angles in such a manner, it is possible to adjust the degree of fluctuation of the sound image localization position by the signal of R to six degrees each to the right and left, which is the same as the degree of fluctuation of the sound image localization position by the signal of C, in a state that the sound image localization position by the signal of R is aligned with the original position of R. These parameters for adjusting the degrees of fluctuation are $\beta$f, $\alpha$f, F_PanF, and F_PanS out of the above-described parameters. By setting $\beta$f, $\alpha$f, F_PanF, and F_PanS at the above-described values, it is possible to adjust the degree of fluctuation of the sound image localization position by the signal of R by six degrees each to the right and left.

By the similar adjustment, with respect to the other signals, it is possible to adjust the degree of fluctuation to six degrees each to the right and left, which is the same as the degree of fluctuation of the sound image localization position by the signals of C.

Figure 11:
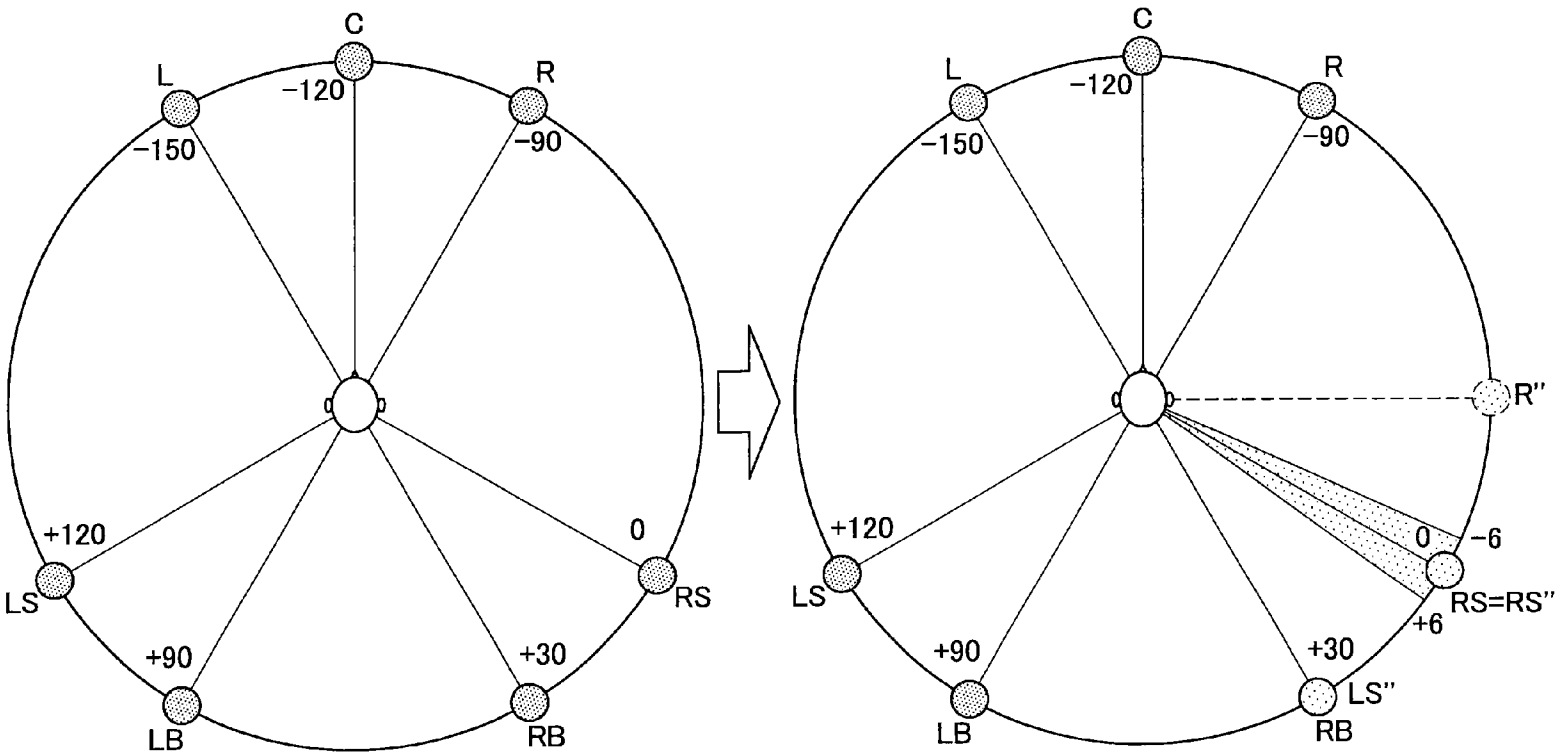
FIG. 11 is an explanatory diagram illustrating the width of fluctuation of the signal of RS.

FIG. 11 is an explanatory diagram illustrating the width of fluctuation of the signal of RS. The signal of RS is also split and distributed to a signal of R and a signal of LS that are positioned at the right and left but not at regular intervals. Therefore, by a procedure similar to the above-described procedure for the signal of R, the degree of fluctuation of the sound image localization position by the signal of RS is adjusted to six degrees each to the right and left. In other words, the sound image localization position by the signal of RS is provisionally set such that R and LS are positioned at regular intervals, the amounts of distribution are adjusted such that the degree of fluctuation is made six degrees across the provisional sound image localization position, and the degree of fluctuation of the sound image localization position by the signal of RS is adjusted to six degrees each to the right and left by the method of returning the provisional sound image localization position to the original sound image localization position. These parameters for adjusting the degree of fluctuation of the sound image localization position by the signal of RS are $\beta$s, $\alpha$s, S_PanF, and S_PanS out of the above-described parameters. By setting $\beta$s, $\alpha$s, S_PanF, and S_PanS at the above-described values, it is possible to adjust the degree of fluctuation of the sound image localization position by the signal of RS by six degrees each to the right and left.

Figure 12:
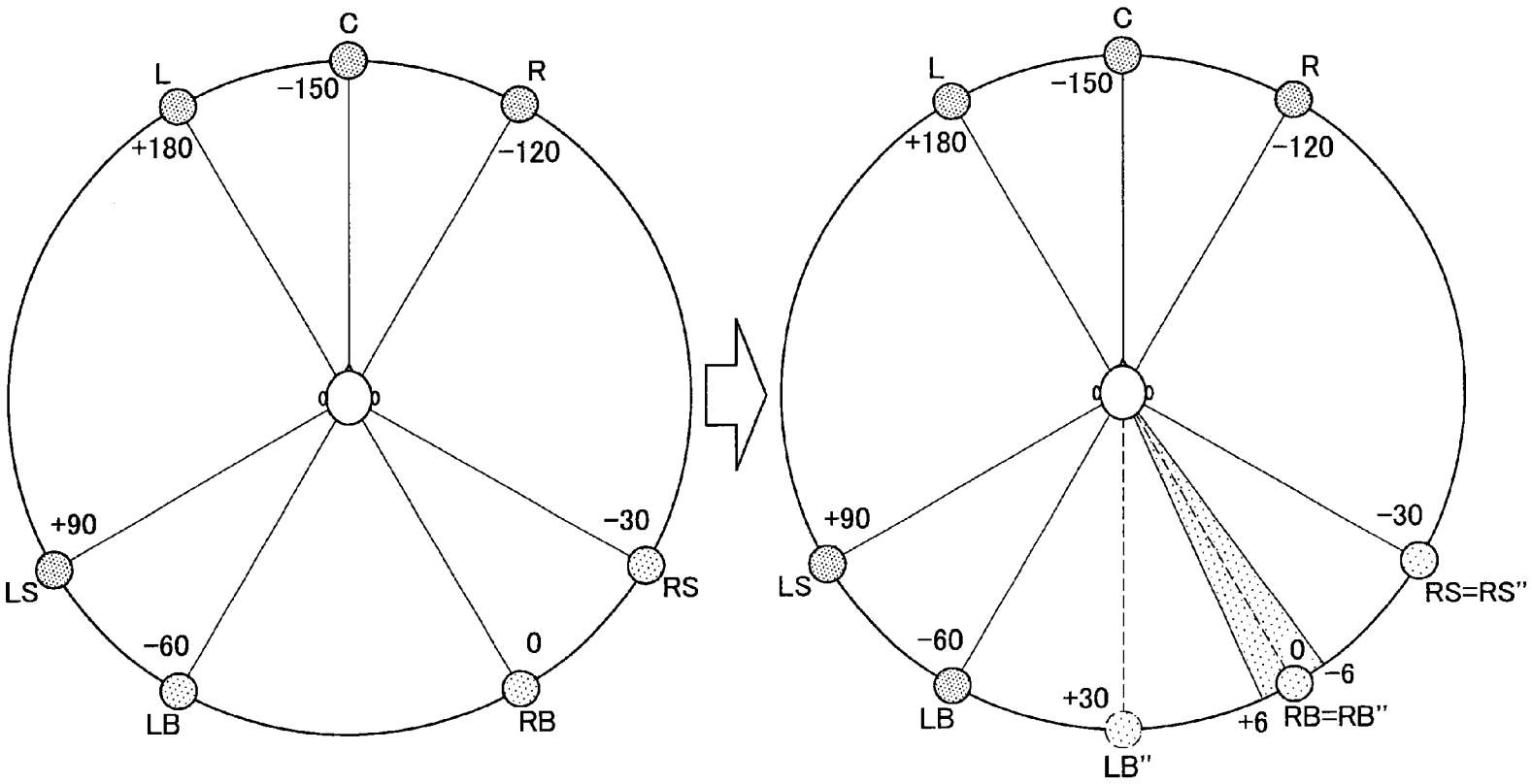
FIG. 12 is an explanatory diagram illustrating the width of fluctuation of the signal of RB.

FIG. 12 is an explanatory diagram illustrating the width of fluctuation of the signal of RB. The signal of RB is also split and distributed to a signal of RS and a signal of LB that are positioned at the right and left but not at regular intervals. Therefore, by a procedure similar to the above-described procedure for the signal of R, the degree of fluctuation of the sound image localization position by the signal of RB is adjusted to six degrees each to the right and left. In other words, the sound image localization position by the signal of RB is provisionally set such that RS and LB are positioned at regular intervals, the amounts of distribution are adjusted such that the degree of fluctuation is made six degrees across the provisional sound image localization position, and the degree of fluctuation of the sound image localization position by the signal of RB is adjusted to six degrees each to the right and left by the method of returning the provisional sound image localization position to the original sound image localization position. These parameters for adjusting the degree of fluctuation of the sound image localization position by the signal of RB are βb, αb, B_PanB, and B_PanS out of the above-described parameters. By setting βb, αb, B_PanB, and B_PanS at the above-described values, it is possible to adjust the degree of fluctuation of the sound image localization position by the signal of RB to six degrees each to the right and left.

Note that, with respect to the signal of L, the signal of LS, and the signal of LB, it is needless to say that the degrees of fluctuation can be adjusted by the procedures similar to those for the signal of R, the signal of RS, and the signal of RB, which are positioned symmetrically with respect to a line connecting a listener and the sound image localization position by the signal of C.

In such a manner, by fluctuating the sound image localization positions for all the audio signals with the same degree of fluctuation, the audio signal processing device 10 according to an embodiment of the present disclosure can perform convolution signal processing, and can improve the sound quality of virtual surround sound after mixing the audio signals to be output to the 2-channel stereo headphones. Furthermore, by fluctuating the sound image localization positions for all the audio signals with the same degree of fluctuation and with the same timing, the audio signal processing device 10 according to an embodiment of the present disclosure can perform convolution signal processing, and can improve the sound quality or expand the sound field of virtual surround sound after mixing the audio signals to be output to the 2-channel stereo headphones.

2. Conclusion

As described above, with the audio signal processing device 10 according to an embodiment of the present disclosure, by convolving the head-related transfer function, at the time of hearing the virtual surround sound with the 2-channel stereo headphones, a desired sense of virtual sound image localization can be obtained. Then, the audio signal processing device 10 according to an embodiment of the present disclosure performs, prior to convolving the head-related transfer function, signal processing of causing the sound image localization position by each audio signal to fluctuate.

By performing the signal processing for causing the sound image localization position by each audio signal to fluctuate, the audio signal processing device 10 according to an embodiment of the present disclosure can improve the sound quality or expand the sound field of virtual surround sound after mixing the audio signals to be output to the 2-channel stereo headphones, prior to convolving the head-related transfer function. Then, since the audio signal processing device 10 according to an embodiment of the present disclosure causes the sound image localization position to fluctuate by the signal processing, it can improve the sound quality or expand the sound field of virtual surround sound, dispensing with a sensor for detecting a shake of the head of a listener. Therefore, even in the case of outputting sound with existing headphones, by using the audio signal processing device 10 of an embodiment of the present disclosure, it is possible to improve the sound quality or expand the sound field of virtual surround sound.

Note that the above-described embodiment of the present disclosure can convolve a head-related transfer function in conformity with a desired and optional hearing environment or room environment, and uses the head-related transfer function with which a desired sense of virtual sound image localization can be obtained, the head-related transfer function configured to eliminate the properties of measurement microphones or measurement speakers. But the present disclosure is not limited to the case of using such a special head-related transfer function, and is applicable even in the case of convolving a general head-related transfer function.

Steps in a process performed by the device in the present specification do not necessarily have to be performed chronologically in the order illustrated as the sequence diagram or flow chart. For example, steps in the process performed by the device may be performed in an order different from the order illustrated as the flow chart or performed in parallel.

In addition, it is possible to make a computer program for causing hardware such as CPU, ROM, and RAM incorporated in the device, to execute the same function as that of the configuration of the above-described device. In addition, it is possible to provide a storage medium in which the computer program is stored. In addition, it is also possible to implement a series of processes using pieces of hardware by configuring each of the functional blocks illustrated by the functional block diagram using the pieces of hardware.

The preferred embodiment of the present disclosure has been described above with reference to the accompanying drawings, but the present disclosure is not limited to the above examples. It is obvious that a person having ordinary skill in the art to which the present disclosure belongs may conceive various alterations or modifications within the scope of the appended claims, and it should be understood that they will naturally come under the technical scope of the present disclosure.

Additionally, the present technology may also be configured as below.

(1)

An audio signal processing device including a signal processing section that changes, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

(2)

The audio signal processing device according to (1), wherein the signal processing section changes the virtual sound image localization positions on the circle in synchronization with all the plurality of channels.

(3)

The audio signal processing device according to (2), wherein the signal processing section changes the virtual sound image localization positions on the circle on a predetermined cycle.

(4)

The audio signal processing device according to (3), wherein the signal processing section changes the virtual sound image localization positions on the circle on a cycle close to a block size used in compressing audio data.

(5)

The audio signal processing device according to (3), wherein the signal processing section changes the virtual sound image localization positions on the circle on a random cycle.

(6)

The audio signal processing device according to (5), wherein the signal processing section changes the virtual sound image localization position on a cycle obtained by adding multiplexed random noises having different cycles.

(7)

The audio signal processing device according to (6), wherein the signal processing section changes the virtual sound image localization positions on a cycle obtained by adding multiplexed random noises having different cycles so as to be closer to a normal distribution.

(8)

The audio signal processing device according to (6), wherein the signal processing section changes the virtual sound image localization positions on a cycle obtained by adding two random noises having different cycles.

(9)

The audio signal processing device according to any one of (1) to (8), wherein the signal processing section changes the virtual sound image localization positions, prior to convolving a head-related transfer function with which a sound image is heard to be localized on the virtual sound image localization position with the audio signal of each of the plurality of channels.

(10)

An audio signal processing method, including a step of changing, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

(11)

A computer program that causes a computer to execute a step of changing, at a time of generating and outputting 2-channel audio signals to be subjected to sound reproduction by two electroacoustic transducing means located at positions in the vicinities of both ears of a listener, from audio signals of a plurality of and more than two channels, virtual sound image localization positions on a circle around the listener, across the virtual sound image localization positions, the virtual sound image localization position that is supposed for each of the plurality of channels of audio signals provided on the circle.

REFERENCE SIGNS LIST

10 audio signal processing device
100 signal processing section

The invention claimed is:

1. An audio signal processing device, comprising:

circuitry configured to:

generate and output 2-channel audio signals from a plurality of channels of audio signals; and change virtual sound image localization positions on a circle around a listener at a time of the generation and output of the 2-channel audio signals from the plurality of channels of the audio signals, wherein the 2-channel audio signals are subjected to sound reproduction by two headphone drivers located at positions in vicinities of both ears of the listener, wherein each of the virtual sound image localization positions that corresponds to one of the plurality of channels of the audio signals is present on the circle, wherein the circuitry is configured to change the virtual sound image localization positions on the circle in synchronization with the plurality of channels of the audio signals, and wherein the circuitry is configured to change the virtual sound image localization positions on the circle on a random cycle.

2. The audio signal processing device according to claim 1, wherein the circuitry is further configured to change the virtual sound image localization positions on the circle on a determined cycle.

3. The audio signal processing device according to claim 1, wherein the circuitry is further configured to change the virtual sound image localization positions on the circle based on a block size used to compress audio data.

4. The audio signal processing device according to claim 2, wherein the circuitry is further configured to change the virtual sound image localization positions on the determined cycle obtained by addition of multiplexed random noises that have different cycles.

5. The audio signal processing device according to claim 2, wherein the circuitry is further configured to change the virtual sound image localization positions on the determined cycle obtained by addition of multiplexed random noises that have different cycles so as to be closer to a normal distribution.

6. The audio signal processing device according to claim 2, wherein the circuitry is further configured to change the virtual sound image localization positions on the determined cycle obtained by addition of two random noises having different cycles.

7. The audio signal processing device according to claim 1, wherein the circuitry is further configured to change the virtual sound image localization positions, prior to convolving a head-related transfer function with an audio signal of each of the plurality of channels, wherein the head-related transfer function is used to obtain a sound image localized on each of the virtual sound image localization positions.

8. An audio signal processing method, comprising generating and outputting 2-channel audio signals from a plurality of channels of audio signals; and changing virtual sound image localization positions on a circle around a listener at a time of the generation and output of the 2-channel audio signals from the plurality of channels of the audio signals, wherein the 2-channel audio signals are subjected to sound reproduction by two headphone drivers located at positions in vicinities of both ears of the listener, wherein each of the virtual sound image localization positions that corresponds to one of the plurality of channels of the audio signals is present on the circle, wherein the virtual sound image localization positions are changed on the circle in synchronization with the plurality of channels of the audio signals, and wherein the virtual sound image localization positions are changed on the circle on a random cycle.

9. A non-transitory computer-readable storage medium having stored thereon computer-executable instructions for causing a computer to execute operations, the operations comprising:

generating and outputting 2-channel audio signals from a plurality of channels of audio signals; and changing virtual sound image localization positions on a circle around a listener at a time of the generation and output of the 2-channel audio signals from the plurality of channels of the audio signals, wherein the 2-channel audio signals are subjected to sound reproduction by two headphone drivers located at positions in vicinities of both ears of the listener, wherein each of the virtual sound image localization positions that corresponds to one of the plurality of channels of the audio signals is present on the circle, wherein the virtual sound image localization positions are changed on the circle in synchronization with the plurality of channels of the audio signals, and wherein the virtual sound image localization positions are changed on the circle on a random cycle.

10. An audio signal processing device, comprising:

circuitry configured to:

generate and output 2-channel audio signals from a plurality of channels of audio signals; and change virtual sound image localization positions on a circle around a listener at a time of the generation and output of the 2-channel audio signals from the plurality of channels of the audio signals, wherein the 2-channel audio signals are subjected to sound reproduction by two headphone drivers, wherein each of the virtual sound image localization positions that corresponds to one of the plurality of channels of the audio signals is present on the circle, wherein the circuitry is configured to change the virtual sound image localization positions on the circle in synchronization with the plurality of channels of the audio signals, and wherein the circuitry is configured to change the virtual sound image localization positions on the circle on a determined cycle, and the determined cycle is obtained by addition of at least two random noises that have different cycles.

11. An audio signal processing device, comprising:

circuitry configured to:

generate and output 2-channel audio signals from a plurality of channels of audio signals; and change virtual sound image localization positions on a circle around a listener at a time of the generation and output of the 2-channel audio signals from the plurality of channels of the audio signals, wherein the 2-channel audio signals are subjected to sound reproduction by two headphone drivers, wherein each of the virtual sound image localization positions that corresponds to one of the plurality of channels of the audio signals is present on the circle, wherein the circuitry is configured to change the virtual sound image localization positions on the circle in synchronization with the plurality of channels of the audio signals, and wherein the circuitry is configured to change the virtual sound image localization positions on the circle on a determined cycle, and wherein the determined cycle is obtained by addition of multiplexed random noises that have different cycles.

12. The audio signal processing device according to claim 11, wherein the circuitry is further configured to change the virtual sound image localization positions on the determined cycle obtained by the addition of the multiplexed random noises that have the different cycles so as to be closer to a normal distribution.

* * * * *